US011051560B2

(12) United States Patent
Spratt

(10) Patent No.: US 11,051,560 B2
(45) Date of Patent: Jul. 6, 2021

(54) CLOTHING SELECTIVELY ENABLING SKIN-TO-SKIN CONTACT

(71) Applicant: Jessica Spratt, Douglas, MA (US)

(72) Inventor: Jessica Spratt, Douglas, MA (US)

( * ) Notice: Subject to any disclaimer, the term of this patent is extended or adjusted under 35 U.S.C. 154(b) by 4 days.

(21) Appl. No.: 15/981,857

(22) Filed: May 16, 2018

(65) Prior Publication Data

US 2018/0332900 A1 Nov. 22, 2018

Related U.S. Application Data

(63) Continuation-in-part of application No. 62/507,067, filed on May 16, 2017.

(51) Int. Cl.

| | |
|---|---|
| ***A41B 13/00*** | (2006.01) |
| ***A41D 11/00*** | (2006.01) |
| ***A41B 9/06*** | (2006.01) |
| ***A41B 13/08*** | (2006.01) |

(52) U.S. Cl.

CPC ..... *A41B 13/005* (2013.01); *A41B 9/06* (2013.01); *A41B 13/08* (2013.01); *A41D 11/00* (2013.01); *A41B 2400/44* (2013.01)

(58) Field of Classification Search

CPC ..... A41B 13/005; A41B 13/08; A41B 9/06; A41B 2400/44; A41D 11/00

See application file for complete search history.

(56) References Cited

U.S. PATENT DOCUMENTS

| | | | | |
|---|---|---|---|---|
| 2,918,677 | A * | 12/1959 | Pindyck | A41B 9/06 2/111 |
| 3,166,763 | A * | 1/1965 | Wells | A41B 13/08 2/112 |
| 3,344,435 | A * | 10/1967 | Artzt | A41B 13/08 2/111 |
| 5,023,952 | A * | 6/1991 | Palmer | A41B 13/005 2/69 |
| 5,946,725 | A | 9/1999 | Shatzkin et al. | |
| 6,223,352 | B1 | 5/2001 | Watlington | |
| 7,409,726 | B2 | 8/2008 | Bahm et al. | |
| 7,665,151 | B1 | 2/2010 | Finell | |
| 7,971,272 | B2 | 7/2011 | Bailey et al. | |

(Continued)

FOREIGN PATENT DOCUMENTS

EP 2446759 B1 11/2013

*Primary Examiner* — Khaled Annis

(74) *Attorney, Agent, or Firm* — Patrick Reilly

(57) ABSTRACT

A unified garment and method of use thereof are provided wherein the garment that includes a pair of adjustable panels that alternately enable (1.) covering a selected portion of skin of a wearer of the garment; and (2.) exposing the selected portion of the wearer's skin without requiring the wearer to disrobe from the garment. Each panel extends from a same inferior portion of the garment and are detachably attachable at respective attachment points to cause a tension to be imposed between each attachment point and the inferior portion. The garment may include a first pair of apertures adapted to each separately receive a wearer's arm and/or a second pair of apertures adapted to each separately receive a wearer's leg. The garment allows exposure of a wearer's skin to enable direct contact between the garment wearer and the skin of another person for the practice of skin to skin contact.

29 Claims, 26 Drawing Sheets

(56) References Cited

U.S. PATENT DOCUMENTS

| | | | | |
|---|---|---|---|---|
| D692,209 | S | 10/2013 | Dragu | |
| D698,521 | S | 2/2014 | Ott et al. | |
| 8,690,835 | B1 | 4/2014 | Parris | |
| D741,046 | S | 10/2015 | Pelekanou | |
| D742,097 | S | 11/2015 | Dunn | |
| 9,456,636 | B2 | 10/2016 | Blomberg | |
| 2008/0250541 | A1 | 10/2008 | Chen | |
| 2010/0024092 | A1 | 2/2010 | Finell | |
| 2010/0122390 | A1 | 5/2010 | Sender | |
| 2012/0125347 | A1 | 5/2012 | Soileau | |
| 2012/0297518 | A1* | 11/2012 | Aiken | A41B 13/005 2/80 |
| 2013/0298305 | A1 | 11/2013 | Lushaj | |
| 2014/0250558 | A1 | 9/2014 | Russo | |
| 2014/0259274 | A1 | 9/2014 | Savage | |
| 2015/0121603 | A1 | 5/2015 | Lang | |

* cited by examiner

CLOTHING SELECTIVELY ENABLING SKIN-TO-SKIN CONTACT

CO-PENDING PATENT APPLICATION

This Nonprovisional Patent Application is a Continuation-in-Part Application to Provisional Patent Application Ser. No. 62/507,067 filed on May 16, 2017 and titled "CLOTHING SELECTIVELY ENABLING SKIN-TO-SKIN CONTACT". Provisional Patent Application Ser. No. 62/507,067 is hereby incorporated by reference in its entirety and for all purposes, to include claiming benefit of the priority date of filing of Provisional Patent Application Ser. No. 62/507,067.

FIELD OF THE INVENTION

The present invention relates to the field of clothing. More particularly, the present invention relates to adjustable clothing that enables exposure of a wearer's skin to enable skin-to-skin contact with another person.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

An infant's transition from the consistent, protected, stable intrauterine experience to the variable, unpredictable life outside the womb can be challenging. In the womb, nutrients are automatic, temperature is always optimal, sound is modulated, boundaries are malleable and supportive and it offers maternal contact 100% of the time. Once outside the womb, the infant meets significant new physiological, environmental and regulatory challenges. The infant must successfully breastfeed for nourishment, regulate its own temperature, adapt to noises that may be startling or often too loud, learn to move it's extremities without the ease of amniotic fluid, and appropriately regulate its respirations, heart rate and biochemistry in response to it's new environment.

A well endorsed practice called skin-to-skin contact has been found to be a tremendous tool in bridging the gap between intra and extrauterine life for infants. Early skin-to-skin contact begins ideally at birth but can begin any time between one and 24 hours post birth. Skin-to-skin contact involves placing the naked baby, prone on the mother's bare chest. What the mother wears and how the baby is kept warm may vary but what is most important is that the mother and baby are in direct ventral-to-ventral SKIN-TO-SKIN CONTACT and the infant is kept dry and warm. "According to mammalian neuroscience, the intimate contact inherent in this place (habitat) evokes neurobehaviors ensuring fulfillment of basic biological needs. This time may represent a psychophysiologically 'sensitive period' for programming future physiology and behavior." It is postulated that when the infant is placed skin-to-skin with the mother, it stimulates responses that help to meet the newborn's basic biological needs, activates neuroprotective mechanisms, enables early self-regulation. Skin-to-skin seems to influence state organization and motor system modulation. For example, the risk of neonatal hypothermia is reduced by skin-to-skin care as the maternal breast quickly adjusts in temperature to regulate her newborn's temperature, promoting thermoregulation. Or immediate skin-to-skin care enables colonization of the newborn to maternal flora (vs. hospital flora).

There are barriers to providing skin-to-skin contact. Readying the infant for skin-to-skin can be a problematic task. Due to the sensitivity of the infant's state, fully disrobing the infant to participate in skin-to-skin contact may cause distress due to poor self-regulation such as temperature changes, over arousal, or waking the infant. Presently, no garment exists for quick and easy exposure of the infant's ventral surface. Present garments comprised of numerous snaps or buttons that are time consuming and sub optimally placed. Once opened, zippers or fasteners can slide under the child while performing skin-to-skin contact and cause discomfort.

Due to the numerous benefits of skin-to-skin contact, it is believed by this author that skin-to-skin is a practice that is beneficial to continue after an infant is discharged from the hospital. Having a garment that makes this an effortless process could help mothers to more readily engage in this practice at home.

Skin-to-skin contact immediately after birth for stable mothers and babies is recommended by all major organizations including The World Health Organization (WHO), the American Academy of Pediatrics, the Academy of Breastfeeding Medicine, and the Neonatal Resuscitation Program. There are over 280 articles published on the effects of skin-to-skin mother—infant holding. A systematic review concluded that evidence supports recommendations for skin-to-skin care for all full-term, healthy newborns. The main results of the meta-analysis, and from the single studies, indicate that skin-to-skin contact appears to have a positive effect on breastfeeding one to four months postbirth, blood glucose, infant crying and on infant temperature stability and has no apparent short- or long-term negative effects.

The benefits of skin-to-skin care extend well after birth because the mother and infant physical and emotional need for each other continues. Only when they are together can the mother observe her baby's states, needs and implement well being. The essential practice of being together also allows unlimited opportunities for skin-to-skin care and breastfeeding. Breastmilk has been shown to have a positive impact on both short- and long-term child health. Children who are not optimally breastfed are at higher risk for short- and long-term illnesses and diseases such as diarrhea, lower respiratory infections, sudden infant death syndrome, Type 1 and Type 2 diabetes, obesity, elevated cholesterol, pneumonia, and leukemia (Ip et al., Year 2007; Ip, Chung, Raman, Trikalinos, & Lau, Year 2009). Exclusive breastfeeding for 6 months is among the most significant strategies to improve infant and child health and reduce childhood illness and mortality. U.S. health experts, e.g., the U.S. Department of Health and Human Services (Year 2010, recommend that breastfeeding continue for at least one year and international health experts recommend at least two years e.g., the World Health Organization (Year 2010). Thus keeping mothers and babies together, allows for improved access and opportunity for breastfeeding and is a significant strategy for improving the occurrence, frequency and success of breastfeeding.

It is understood that infants are preferably clothed in garments that keep the wearers warm enough to support a healthy body temperature, insulating the wearer from heat, and protect the wearer from abrasions. Presently, the prior art does not provide an infant garment that optimally allows a caregiver to effortlessly and quickly prepare an infant to participate in skin-to-skin contact, all while maintaining the infant in a protected, stable physiological state. Moreover, the prior art fails to optimally address the effect that human infants, to include babies and children under three years of age, are known to respond positively to skin-to-skin contact with their mothers or other human caregivers. Furthermore, prior infant clothing designs provide covering fabric and other protective materials that do not optimally allow occasional and convenient exposure of the infant wearer's skin without partial or full disrobing of the infant from this prior art clothing.

Prior art garments take an undesirably long time to prepare an infant for skin-to-skin contact. Prior art infant clothing can be problematic in dressing or undressing an infant. New parents are often afraid to pull garments over a new infant's head as an infant's neck muscles aren't possibly not yet developed enough to allow pulling over child's head. Most infant clothing is made of fabric that doesn't stretch well. It can be difficult with prior art clothing to secure snaps on an infant who is crying, upset or kicking. Many snaps are time consuming, especially when diaper changes are occurring many times a day. Undressing an sleeping infant in a prior art garments can wake the child.

Prior art garment for infants do not optimally enable easy and quick total or substantive exposure of an infant's torso without having to completely undress the child. Prior art infant one piece clothing either have eight or more snaps down the front making donning and doffing laborious, and/or requiring the prior art clothing to be pulled over the infant's head. Other "kimono" style prior art one piece clothing still have at least four snaps. It is understood that depending on an immediate environment, it may not be desirable to remove an entire infant's garment and with most prior art garments one must do so to enable substantive skin-to-skin contact. Another common prior art failing is that zippers or snaps of infant garments can become caught between the infant and a mother's skin and thereby cause discomfort to either or both mother and child.

There is therefore a long-felt need to provide clothing and a method of use thereof that more conveniently and effectively provides selective exposure of a portion of a human infant's skin to enable a bringing an area of the clothing wearer's skin with either the skin of another party or with material that is coupled with another person's body.

SUMMARY AND OBJECTS OF THE INVENTION

Towards these objects and other objects that will be made obvious in light of the present disclosure, the present invention (hereinafter, "the invented garment") and method of use thereof are provided that alternately enable (1.) covering a selected portion of skin of a wearer of the invented garment; and (2.) exposing the selected portion of the garment wearer's skin without requiring the wearer to disrobe from the invented garment.

Certain alternate preferred embodiments of the invented garment provide two snap fastener assemblies (hereinafter, "snaps" or "snap assemblies") positioned at the top of the garment, i.e., when the two snaps are placed at a garment area preferably positioned near the wearer's neck when the two snaps are snapped closed to place the garment into a closed state about an infant wearing the invented garment (hereinafter, "the infant wearer"). When these two snaps are unsnapped two cloth panels of the invented garment may be opened widely to place the invented garment into a second state, thereby exposing most of the entire ventral surface of the infant wearing the invented garment so that the infant can be placed skin to skin upon a mother's bare chest, or a skin area or the mother or another person.

In an optional aspect of the invented garment, the portions of each of these two snaps can also be snapped together behind the wearer infant's body, thereby reducing a risk that the infant garment wearer does not accidentally rest on a snap. This snapping together of separate elements of each of the two snaps behind the infant's back also ensures that the two panels do not undesirably fall onto and cover up the infant's exposed front body or exposed chest area.

In an another optional aspect of the invented garment, a four-way stretch fabric of the invented garment provides that no snaps are needed in the leg coverings of the invented garment, thereby allowing for quick removal of the garment for diapering of the wearer infant.

A first preferred embodiment of the invented garment is garment sized and configured for being worn by an infant or other human, the garment providing a superior pair of laterally opposed apertures, an inferior pair of laterally opposed apertures and a frontal opening, the frontal opening defined by a first side, a second side, and a inferior side within the garment, wherein the inferior side extends from the first side to the second side. The first preferred embodiment of the invented garment (hereinafter, "the first garment") includes a first panel portion of fabric (hereinafter, "first panel") and a second panel portion of fabric (hereinafter, "second panel"). The first panel may be integrally coupled with the garment first side, and the first panel may have a first detachable attachment feature for detachable attachment to the garment second side, wherein the first panel adjustably extends from the first detachable attachment feature to the garment second side. The second panel may be integrally coupled with the garment second side and the inferior side, and the second panel may have a second detachable attachment feature for detachable attachment to the garment first side, wherein the second panel adjustably extends from the second detachable attachment feature to the garment first side, whereby, with the garment worn by the infant or other person, both panels are alternately positionable to allow contact with the garment wearer's skin area or closed to protect the garment wearer's skin area, e.g., a portion of or comprising skin covering the garment wearer's chest.

The first detachable attachment feature and or second detachable attachment feature may be comprised within respective first snap assemblies.

The first garment optionally further comprises one or more of the following: (a.) a legging coupled with one of the inferior laterally opposed garment apertures; (b.) a second legging coupled with the other inferior laterally opposed garment aperture; (c.) a sleeve coupled with one of the superior laterally opposed garment apertures; (d.) a second sleeve coupled with the other superior laterally opposed garment aperture; (e.) two leggings, each legging separately coupled with a separate inferior laterally opposing garment aperture; (f.) two sleeves, each sleeve separately coupled with a separate superior laterally opposing garment aperture.; (g.) at least one legging comprises a booting element sized and shaped to snugly enclose one foot of the infant; (h.) a first reinforcing tab positioned on the garment for engagement with the first detachable attachment feature; (i.) a second reinforcing tab positioned on the garment for engagement with the second detachable attachment feature;

(j.) an additional detachable attachment feature coupled with the first panel; (k.) a second additional detachable attachment feature coupled with the second panel; (l) a first detachable attachment feature comprising a first hook and loop fastener set; (m.) a second detachable attachment feature comprising a second hook and loop fastener set; (n.) an additional fourth detachable attachment feature comprising an additional hook and loop fastener set; (o.) a hooding element coupled with the first garment; (p.) at least one detachably attached hand mitten; (q.) a first panel and a second panel each have separate and distinct coloring; (r.) the invented garment being sized and shaped to fit snugly about the infant; (s.) a legging sized and shaped to fit snugly about a leg of the infant; (t.) a sleeve sized and shaped to fit snugly about an arm of the infant; (u.) a fabric selected from the garment group consisting of cotton, wool, organic fabric, and/or synthetic fabric in singularity or in combination; and (v.) a neck collar.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE FIGURES

These, and further features of the invention, may be better understood with reference to the accompanying specification and drawings depicting the preferred embodiment, in which.

DETAILED DESCRIPTION

Figure 1A:
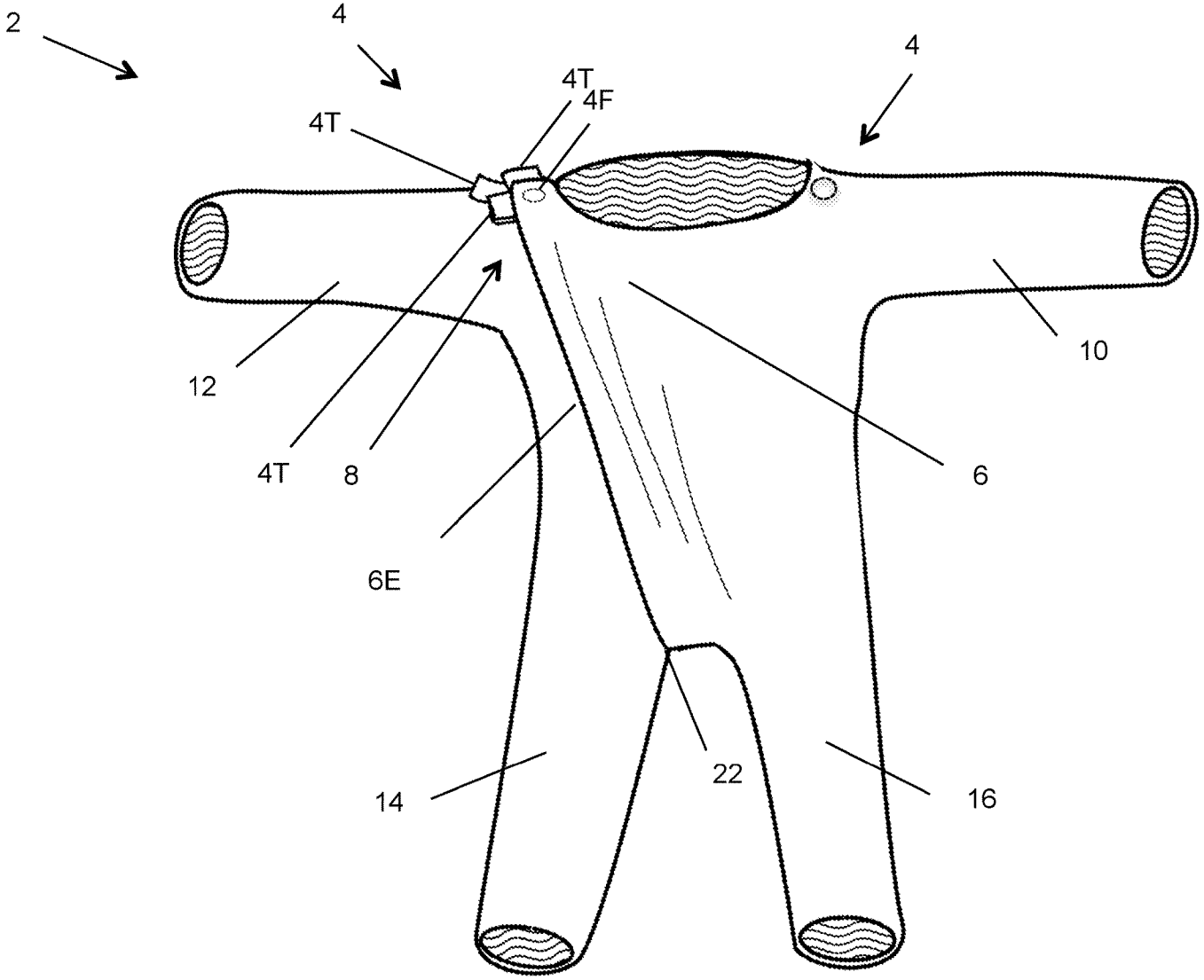
FIG. 1A is a front view of a first preferred embodiment of the invented garment is a closed state.

Referring now generally to the Figures and particularly to FIGS. 1A, 1B, 1C and 1D, a first preferred embodiment the invented garment 2 (hereinafter, "the first design" 2) includes a snap assembly 4 that detachably fixes an outer panel 6 at an upper right shoulder point 8 of the first design 2. As shown in FIG. 1B and FIG. 1C, each snap assembly includes a male snap element 4M and a female snap element 4F, wherein each male snap element 4M presents a lame snap post that is sized and centrally positioned to fit into a centrally positioned receiver of a female snap element that is undersized to form a friction fit with a male snap post.

Optional tabs 4T are each optionally dedicated and separately attached to a single male snap element 4M and a single female snap element 4F. An optional left sleeve 10 is positioned to extend along and partially enclose a left arm of an infant wearer's body (not shown); an optional right sleeve 12 is positioned to extend along and partially enclose a right arm of an infant wearer's body; an optional right legging 14 is positioned to extend along and partially enclose a right leg of the infant wearer's body; and an optional left legging 16 is positioned to extend along and partially enclose a left leg of the infant wearer's body.

Referring now generally to the Figures and particularly to FIG. 1B, a second panel 18 of the first design 2 is shown to be detachably fixed at an upper left shoulder point 20 of the invented garment 2 by means of an additional snap assembly 4. FIG. 1B also clearly shows that the outer panel 6 and the second panel 18 are both preferably fixedly attached at lower panel point 22, wherein the lower panel point 22 is located proximate to the right legging 14 and distal from the left legging 16. It is understood that in certain alternate preferred embodiments of the first design 2 that the lower panel point 22 may be located distal from the right legging 14 and proximate to the left legging 16. The locating of lower endpoints of both of the panels 6 & 18 of the first design 2 in combination proximate to the right legging 14 or alternatively the left legging reduces over the prior art a need for seams or fasteners in the first design 2; this locating also allows for a wider displacement of the panels 6 & 18 to allow greater exposure of the infant wearer's chest and torso skin; and further enables an optimal line of pull versus the prior art (a.) of the outer panel 6 between the lower panel point 22 and the upper right shoulder point 8; and (b.) of the second panel 18 between the lower panel point 22 and the upper left shoulder point 20

Referring now generally to the Figures and particularly to FIG. 1C, the outer panel 6 and second panel 18 are shown in an open state whereby the infant wearer's chest torso are would be exposed for pressing against a body of another person, preferably a mother or parent of the infant wearer.

Figure 1B:
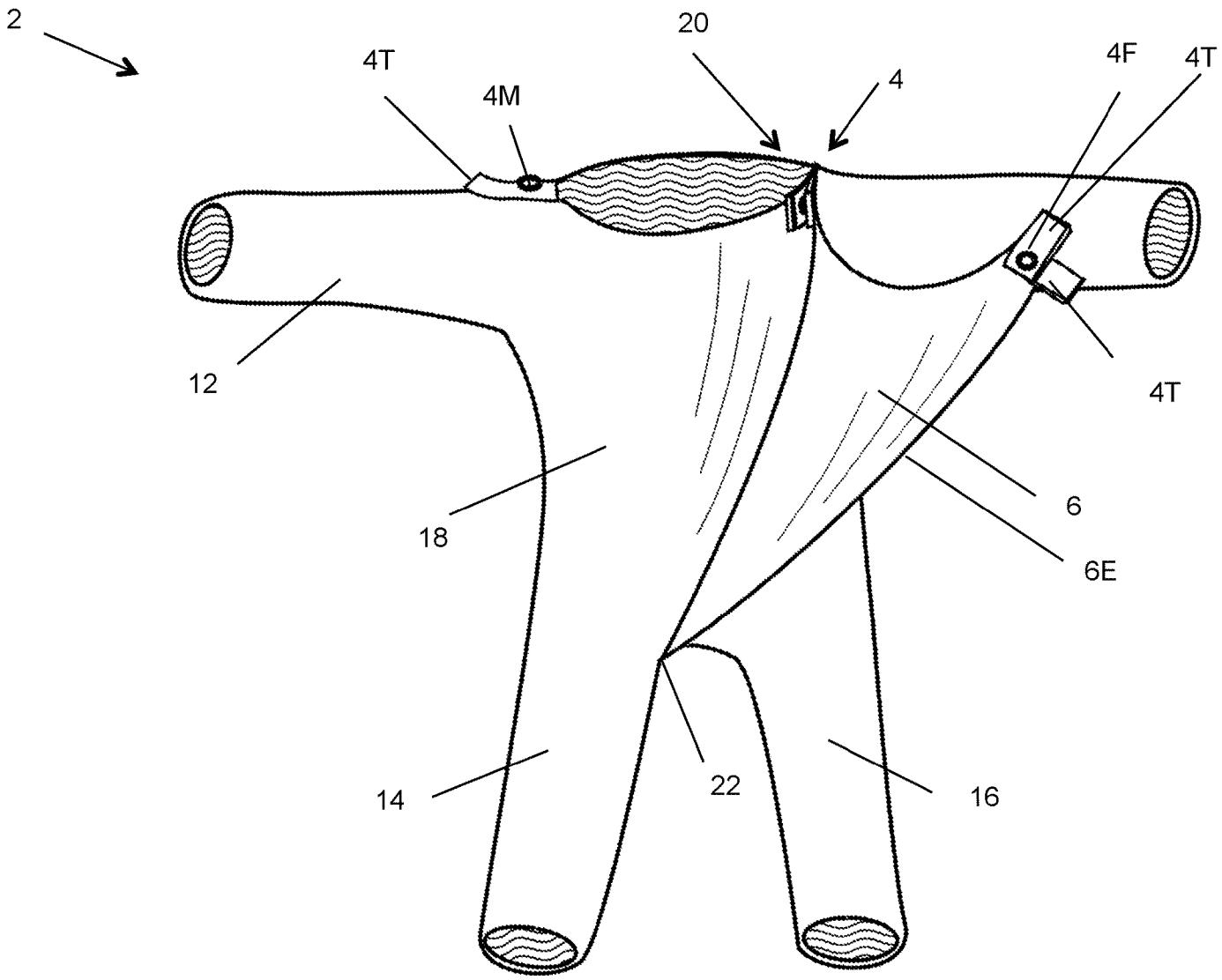
FIG. 1B is a front view of the first preferred embodiment of the invented garment of FIG. 1A with one panel open.
Figure 1C:
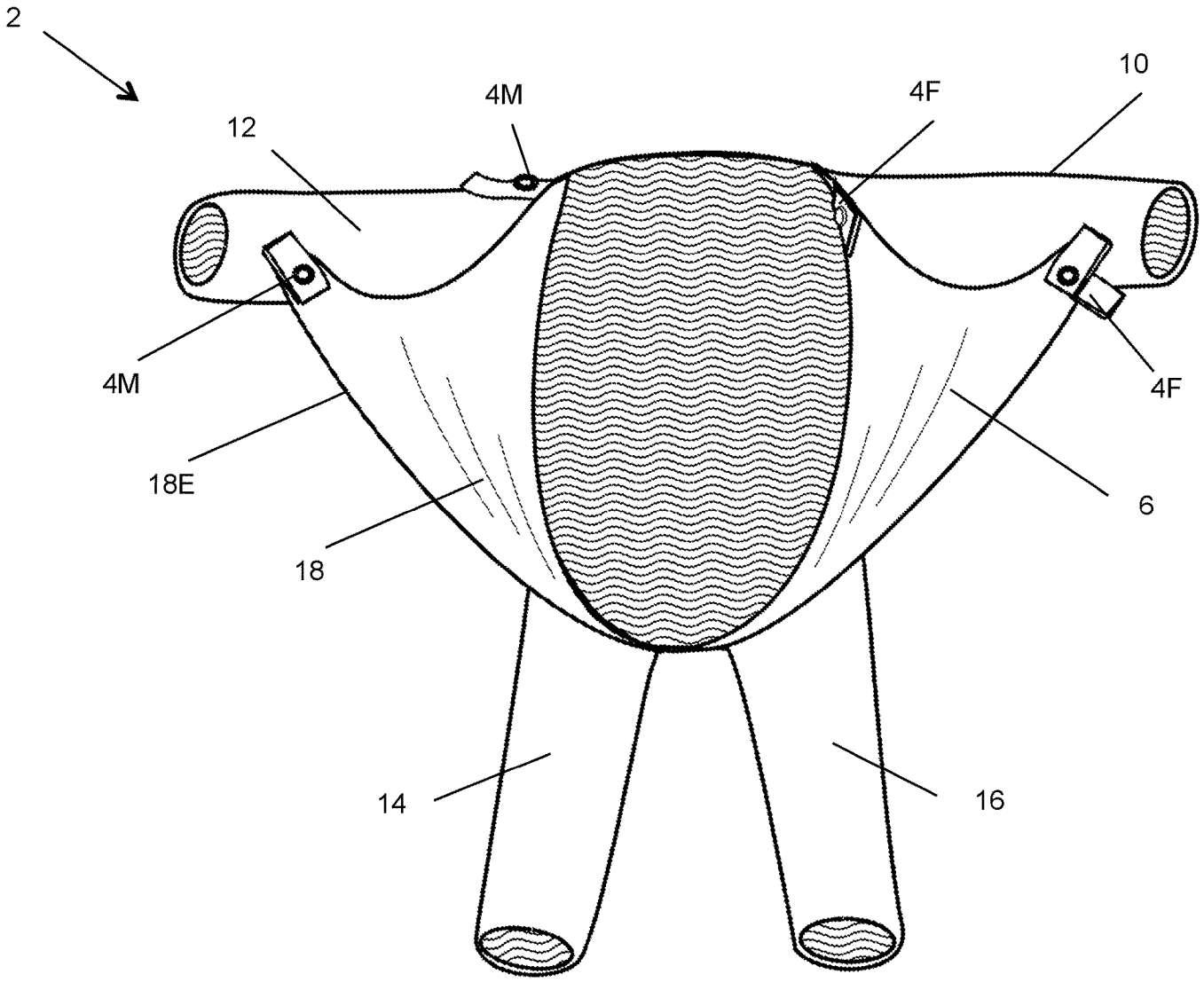
FIG. 1C is a front view of the first preferred embodiment of the invented garment of FIG. 1A with both panels open.
Figure 1D:
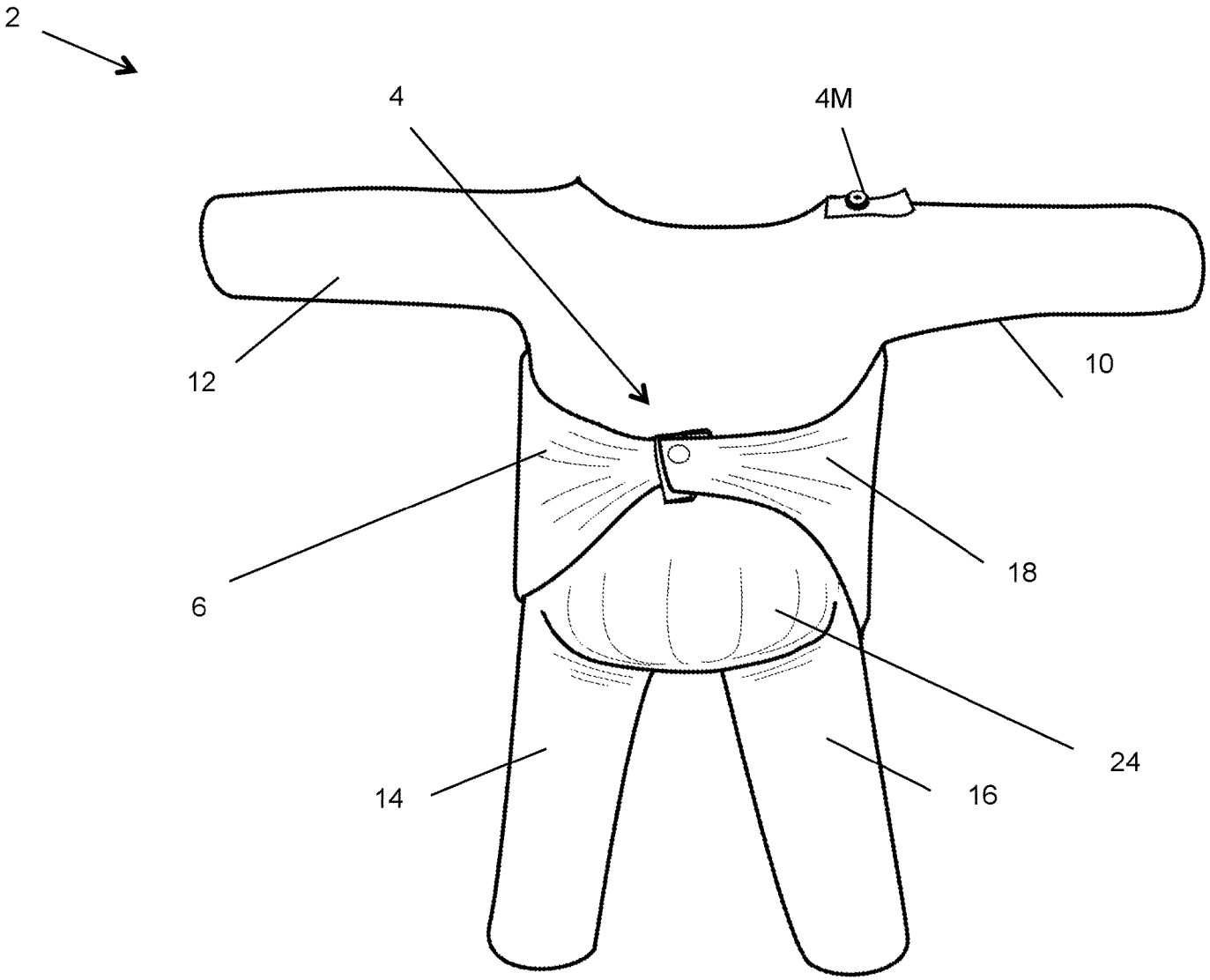
FIG. 1D is a back view of the first preferred embodiment of the invented garment of FIG. 1A with both panels detachably attached to each other.

It is understood that in other alternate preferred embodiments of the invented garment that the outer panel 6 and the second panel 18 may be attached to or extend form alternate sides within the invented garment Referring now generally to the Figures and particularly to FIG. 1D, the outer panel 6 and the second panel 18 are detachably fixed at the back of the infant wearer by snap assembly 4 formed by male snap element 4M affixed to the second panel 18 and a female snap element 4F affixed to the outer panel 6. It is understood that the first panel 16 and/or the second panel 18 are each substantively triangular in shape.

The first design 2 is preferably formed with an abundance of fabric sufficient to provide a gathering 24 that defines a volume to accept a diaper as worn about the infant wearer while wearing the first design 2.

As shown in FIG. 1A, when the two panels 6 & 18 are attached with the snap fastener assemblies 4 (hereinafter, "snap assemblies" 4), an outer edge 6E of the outer panel 6 pulls from the inside right leg crotch point 22, across the body to the upper right clavicle shoulder point 8. An additional outer edge 18E of the inner panel 18 pulls same inside right leg crotch point 22 across the infant wearer's body to the upper left clavicle shoulder point 20. Prior art garments have rectangular panels that overlap the entirety of the infant wearer's chest and require at least four, if not more, snaps to secure. The shape that forms the panels 6 & 18 of the first design 2 overlap is a triangle, narrow at the crotch area at the bottom and as wide as the chest at the top. If one imagines a hand being placed on the infant wearer's chest to calm and soothe her, one's hand and wrist would mimic the surface area covered by this V shape as indicated in FIG. 1A. The location and use of the right leg crotch point 22 establish offset seams, i.e., the seam is not straight up the middle of the garment with snap assemblies 4, are more comfortable for infant wearer 'tummy time', i.e., when the infant wearer is placed on her belly to allow access to age appropriate developmental positions, in comparison with the prior art, the infant wearer of the first design 2 isn't lying on uncomfortable snaps or seams.

Furthermore, the first design 2 only requires two snap assemblies 4; this structural feature of the first design allows for ease of quickly and easily exposing the infant's chest for skin-to-skin contact. In addition, no lateral seams are imposed by the first design 2 onto the torso of the infant wearer; less seams compared with the prior art enable the first design 2 to be more comfortable and to allow more stretch, as seams limit stretch. It is understood that with a stretch fabric, it is difficult to secure snaps into a fabric without the fabric ripping over time; the reinforcement tabs 4T prevent the snap assemblies 4 from ripping through the fabric. The tabs 4T also make it easier to unsnap the snap assemblies 4 by proving a secure place to grasp and pull; a user can unsnap the snap assemblies 4 of the first design 4 with one hand by use of the tabs 4T.

It is understood that the first design 2 may comprise fabric selected from fabrics made with or of TENCEL™ fiber manufactured by the Lenzing AG Lenzing, Austria, lyocell, or other suitable sustainable sourced stretchable fabric known in the art, cotton, wool, organic fabric, eco-textile and/or synthetic fabric in singularity or in combination, and/or other suitable fabric known in the art.

In light of research by the HeartMath Institute of Santa Cruz County, Calif., the heart emits a biomagnetic signal that can be measured by electrocardiogram (ECG) and superconducting quantum interference device (SQUID). The heart is the largest producer of electromagnetic signals in the human body. Its electric field is about 60 times larger than the brain and can be detected up to 3 feet away from the body. Work by Feldman, has shown that during face-to-face interactions, a mother unconsciously adapts her heart rhythms to those of her infant, and the infant adapts his or her heart rhythms to those of the mother in less than a second, resulting in a biological synchronization between the accelerations and decelerations of their heart rates. It is speculated that the biological synchronization of the heart rates, the close proximity of the child and mother's hearts and the stimulation of sensory nerve endings in both of their chests may have positive benefits. It may be particularly beneficial if the mother holds the intention of well-being feelings while participating in skin to skin.

Mother and infant coordinate heart rhythms through episodes of interaction synchrony. (Feldman R, Magori-Cohen R, Galili G, Singer M, Louzoun Y Infant Behav Dcv. 2011 December; 34(4):569-77; Feldman R. Parent-infant synchrony biological foundations and developmental outcomes. Curr Dir Psychol Sci (2007) 16(6):340-5.10.1111/j.1467-8721.2007.00532; "From biological rhythms to social rhythms: Physiological precursors of mother-infant synchrony", Feldman R Dev Psychol. 2006 January; 42(1):175-88) "Social engagement and attachment: a phylogenetic perspective", Porges S W Ann N Y Acad Sci. 2003 December; 1008( ):31-47; "The development of regulatory functions from birth to 5 years: insights from premature infants", Feldman R Child Dev. 2009 March-April; 80(2):544-61)'

The following instructions describe enhanced skin to skin practice:

"With the infant securely resting on the parent's lap, unfasten the top two fasteners of the garment exposing the infants entire chest. Place the exposed infant's chest to the exposed mother's chest. Be sure that infant's face is safely turned to the side to allow for normal breathing. Place the infant's feet so that that they are supported and have something to push against, whether it is the mothers abdomen, thighs or a pillow on the mother's lap. Also position the infant's hands slightly under them or near their mouth. The mother may place her hand supporting under the infants bottom and her other hand gently supporting the infant's back. Then close the fastener loosely behind the infants back."

The following instructions describe enhanced skin-to-skin guided practice:

"With the mothers feet firmly supported on the floor. Take a easy slow breath in through the nose and out through the nose bring your awareness to your chest. Take another breath feeling the chest expand and relax. You want your breath to be slower than normal but easy and effortless. Bring your awareness to the sensation of your skin touching the baby skin and feel the beautiful connection you have established. See if you can feel your baby's breath moving in and out.

Next, feel for your own heartbeat. Spend a few minutes allowing your breath to move through this area. Now feel for your baby's heartbeat. This is not effortful, you are simply quieting enough to sense the beautiful life force. of your baby. Bring a feeling of deep appreciation into your heart and of the beautiful life this child is, of the beautiful soul this child is and of the beautiful wisdom this child holds. Feel appreciation for the support that surrounds you, of the infinite possibilities and love. Feel this surround the both of you by imagining a warm, pink, beautiful, sparkling, fuzzy, blanket covered by thousand kisses from this universe. Allow this feeling into your bodies by continuing to breathe slowly, effortlessly and easy."

Figure 2A:
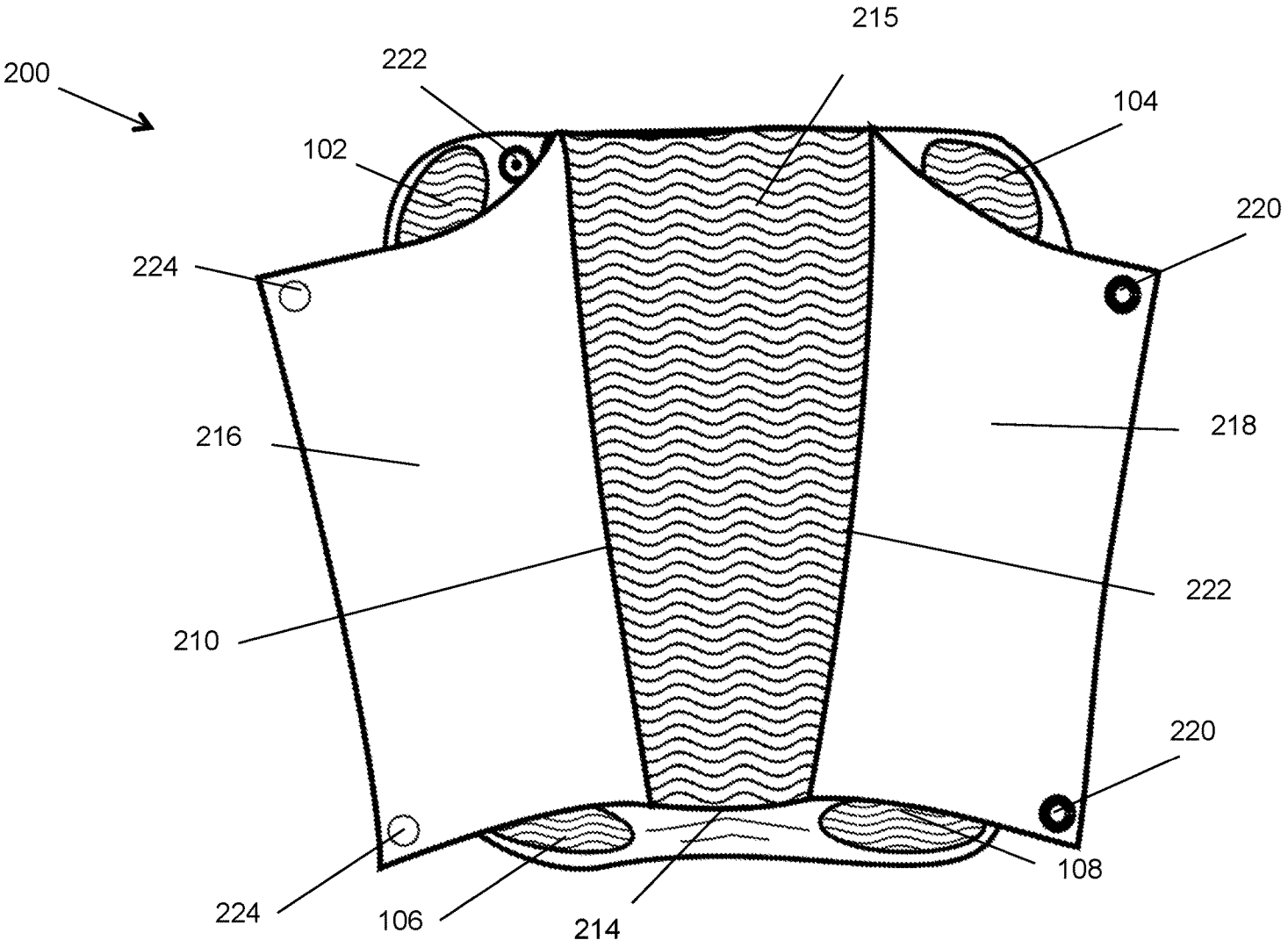
FIG. 2A is a front view of a second preferred embodiment of the invented garment with two panels open.
Figure 2B:
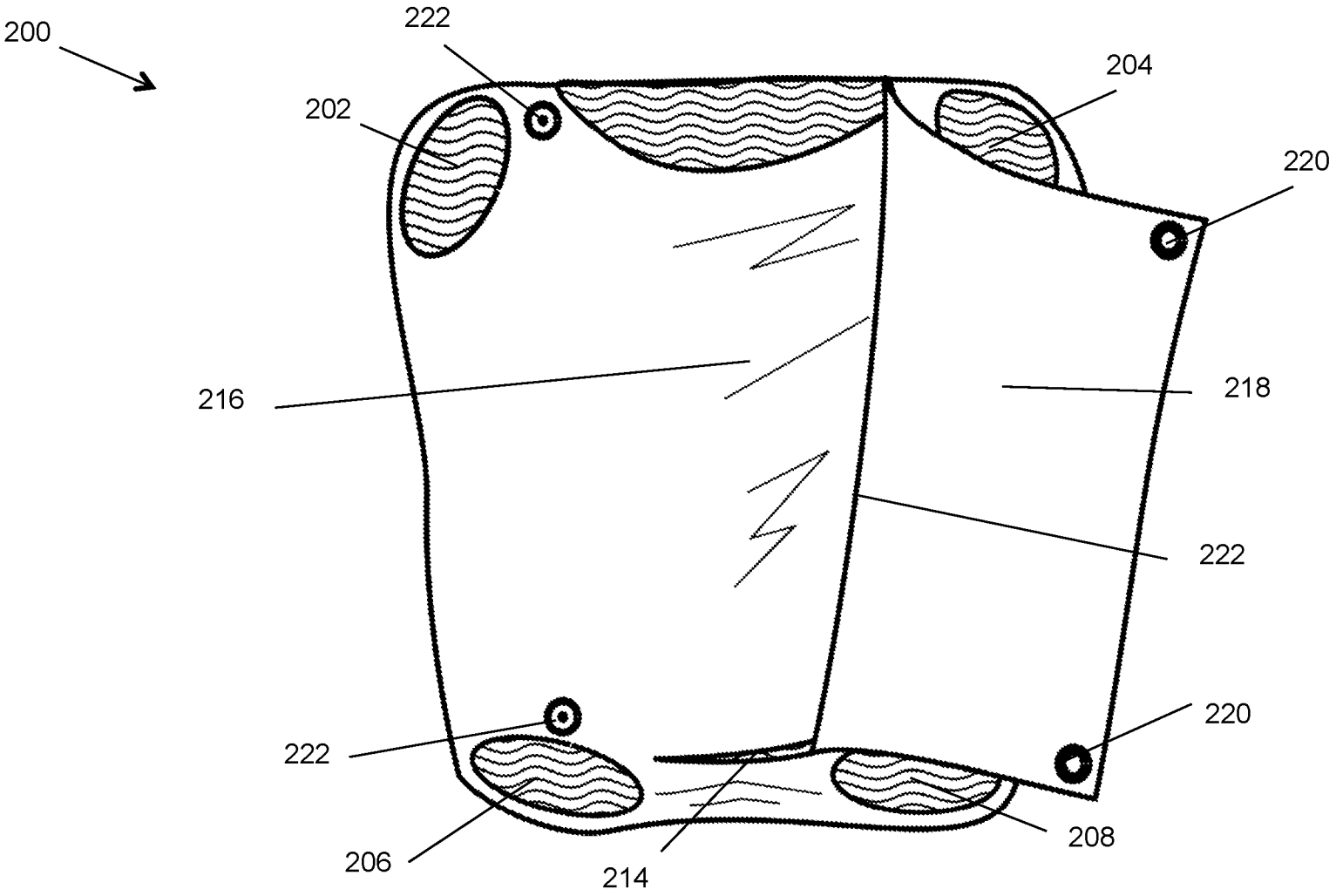
FIG. 2B is a front view of the second preferred embodiment of the invented garment of FIG. 2A with one panel open.
Figure 2C:
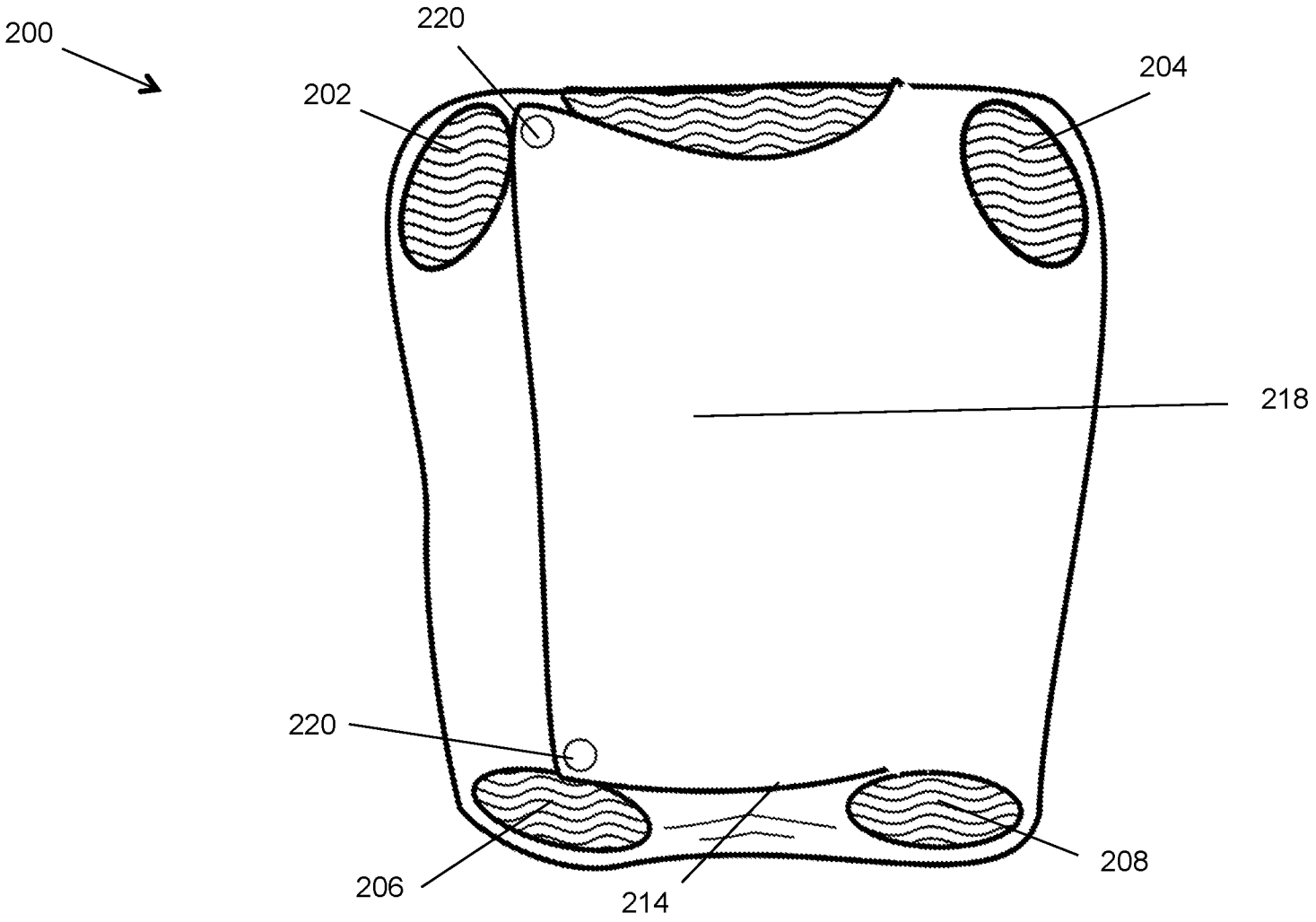
FIG. 2C is a front view of the second preferred embodiment of the invented garment of FIG. 2A with both panels closed.

Referring now generally to the Figures and particularly to FIGS. 2A, 2B and 2C, FIGS. 2A, 2B and 2C present an alternate preferred embodiment of the present invention 200, or second design 200, in a first state of FIG. 2A that exposes a portion of a wearer's skin in FIG. 2A and in an alternative second state of FIG. 2C that would cover, and protect said portion of wearer's skin with the panels 216 & 218. The second design 200 includes limb apertures 202-208, three sides 210, 212 & 214 that define a first 215 aperture that selectively exposes said portion of wearer's skin the first panel 216 and the second panel 218, a plurality of fastener components and elements 220, 222 & 224.

Figure 3A:
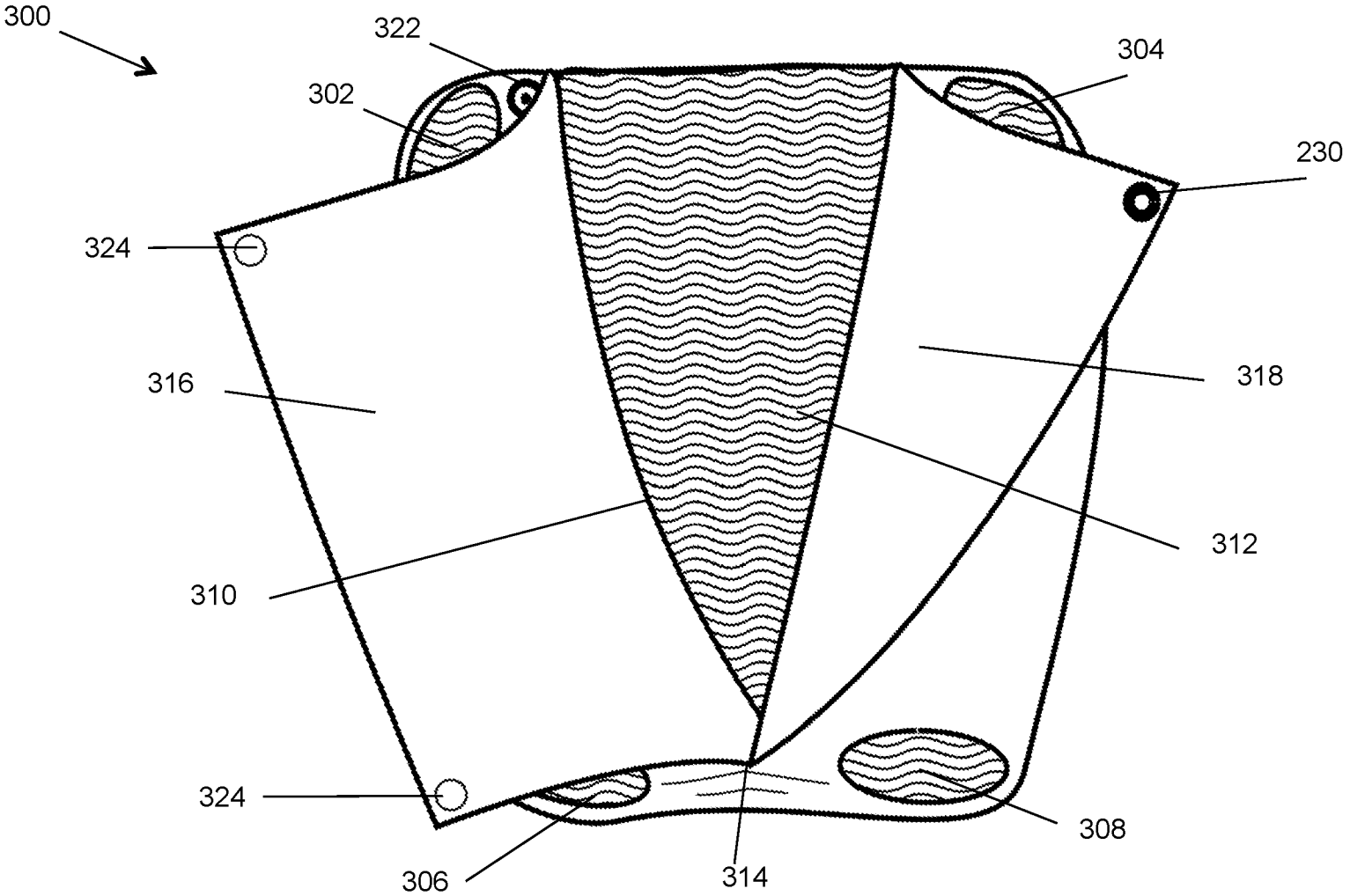
FIG. 3A is a front view of a third preferred embodiment of the invented garment with two panels open.
Figure 3B:
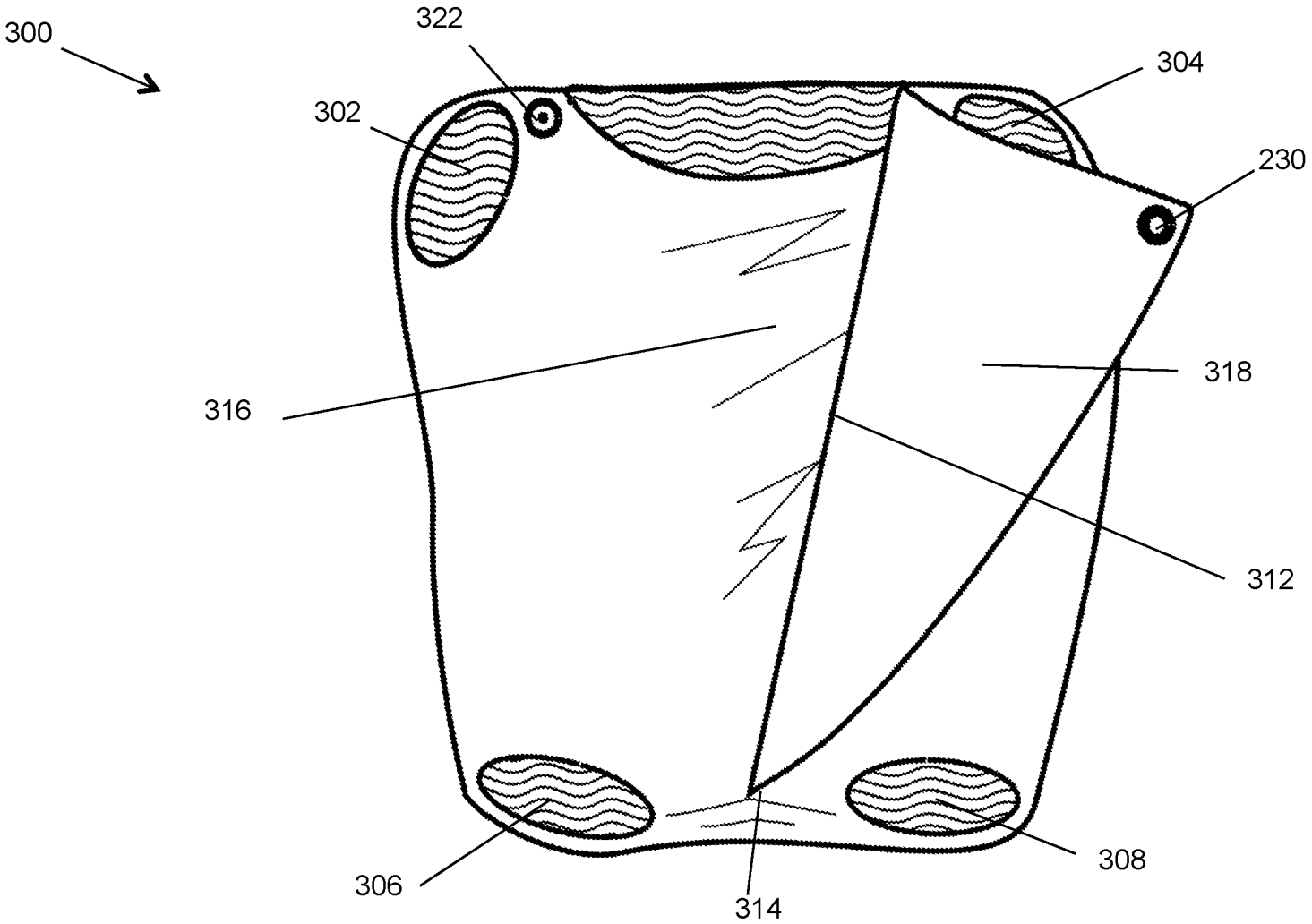
FIG. 3B is a front view of the third preferred embodiment of the invented garment of FIG. 3A with one panel open.
Figure 3C:
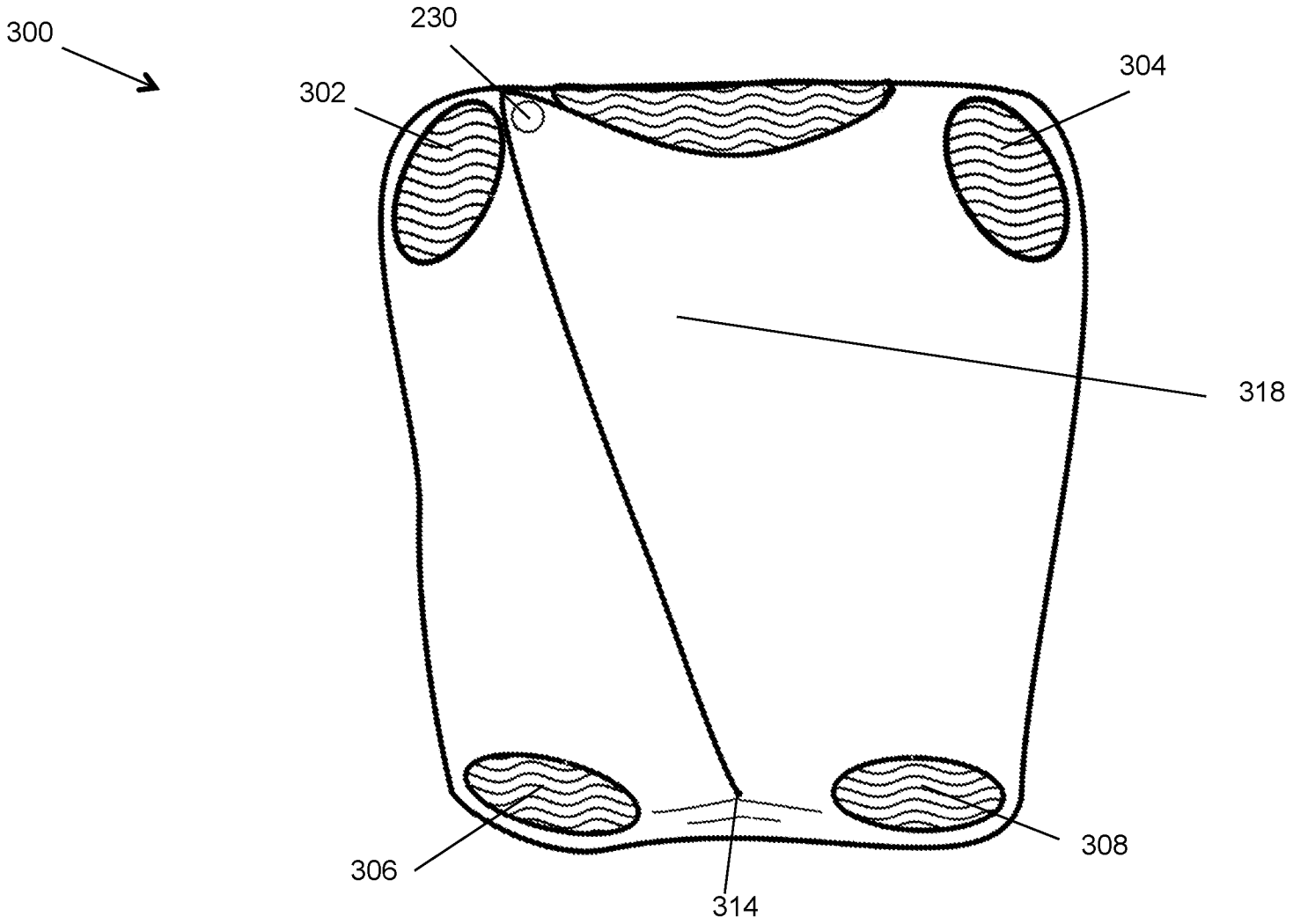
FIG. 3C is a front view of the third preferred embodiment of the invented garment of FIG. 3A with both panels closed.

Referring now generally to the Figures and particularly to FIGS. 3A, 3B and 3C, FIGS. 3A, 3B and 3C present a third alternate preferred embodiment of the present invention 300, or third design 300, in a first state of FIG. 3A that exposes the portion of a wearer's skin in FIG. 3A and in an alternative second state of FIG. 3C that would cover, and protect said portion of wearer's skin with a second set alternate panels 316 & 318. The third design 300 includes limb apertures 302-308, three sides 310 & 314 that define a second aperture 312 that selectively exposes said portion of wearer's skin the first alternate panel 316 and the second alternate panel 318, a plurality of fastener components and elements 320, 322 & 324.

Figure 4A:
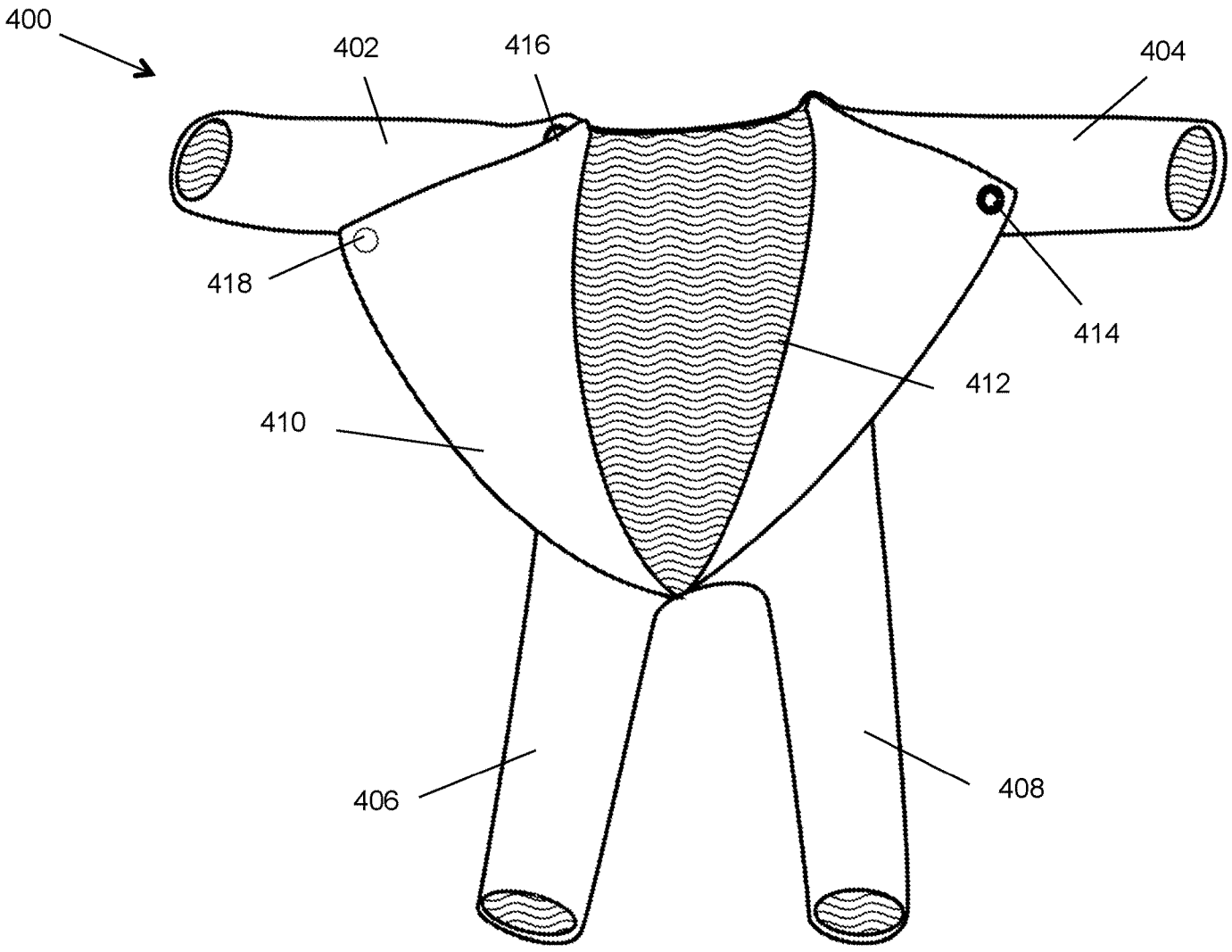
FIG. 4A is a front view of a fourth preferred embodiment of the invented garment with two panels open.
Figure 4B:
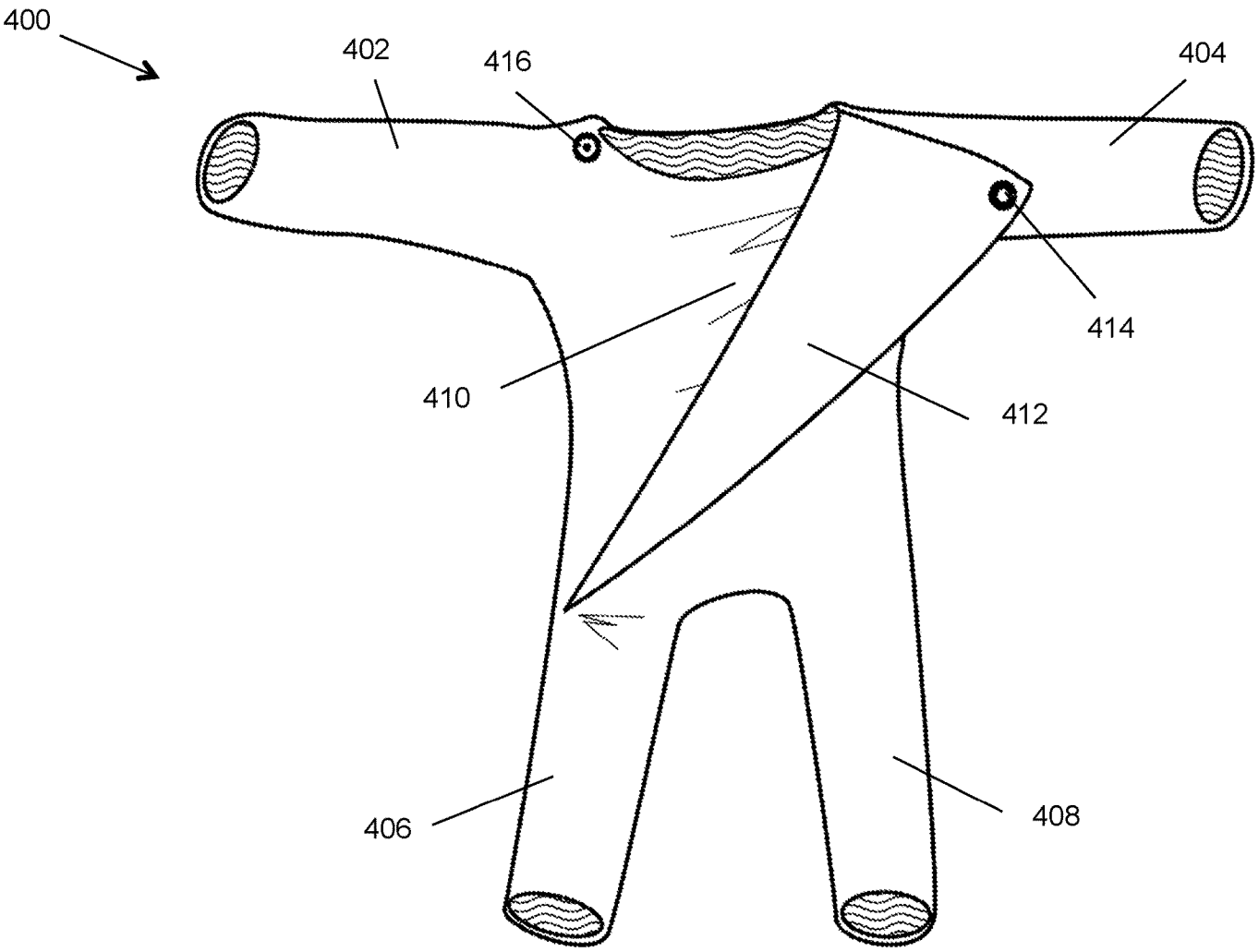
FIG. 4B is a front view of the fourth preferred embodiment of the invented garment of FIG. 4A with one panel open.
Figure 4C:
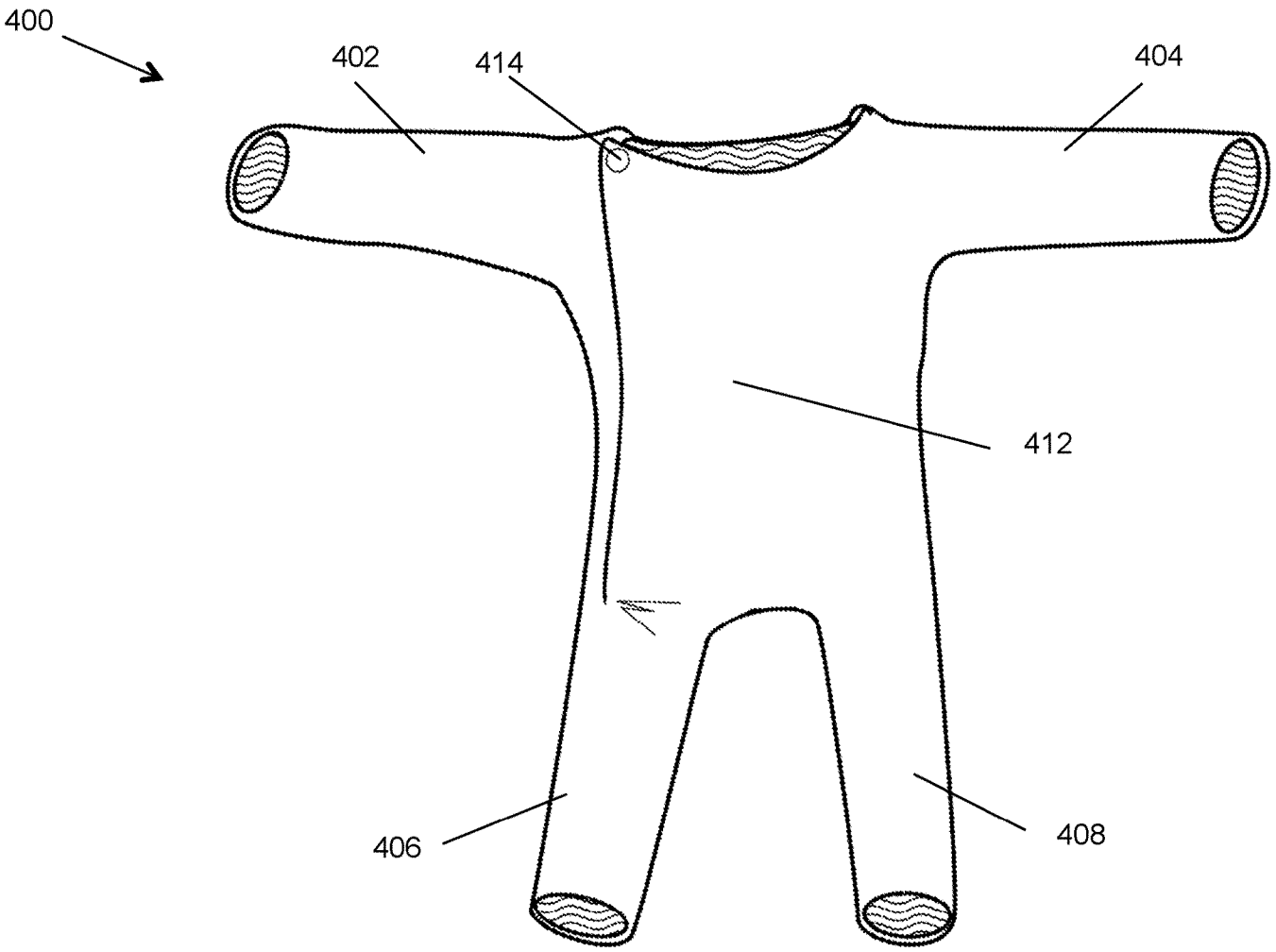
FIG. 4C is a front view of the fourth preferred embodiment of the invented garment of FIG. 4A with both panels closed.

Referring now generally to the Figures and particularly to FIGS. 4A, 4B and 4C, FIGS. 4A, 4B and 4C present a fourth alternate preferred embodiment of the present invention 400, or fourth design 400, in a first state of FIG. 4A that exposes the portion of a wearer's skin in FIG. 4A and in an alternative second state of the fourth design 400 of FIG. 4C that would cover, and protect said portion of wearer's skin with a fourth set of alternate panels 410 & 412. The fourth design 400 includes sleeves 402 & 404 and leggings 406 & 408, a plurality of fastener components and elements 414, 416 & 418. Preferably, there are no snap assemblies 4 on the leggings 406 & 408, thereby allowing for easier and quicker donning/doffing of the fourth design 400.

Figure 5A:
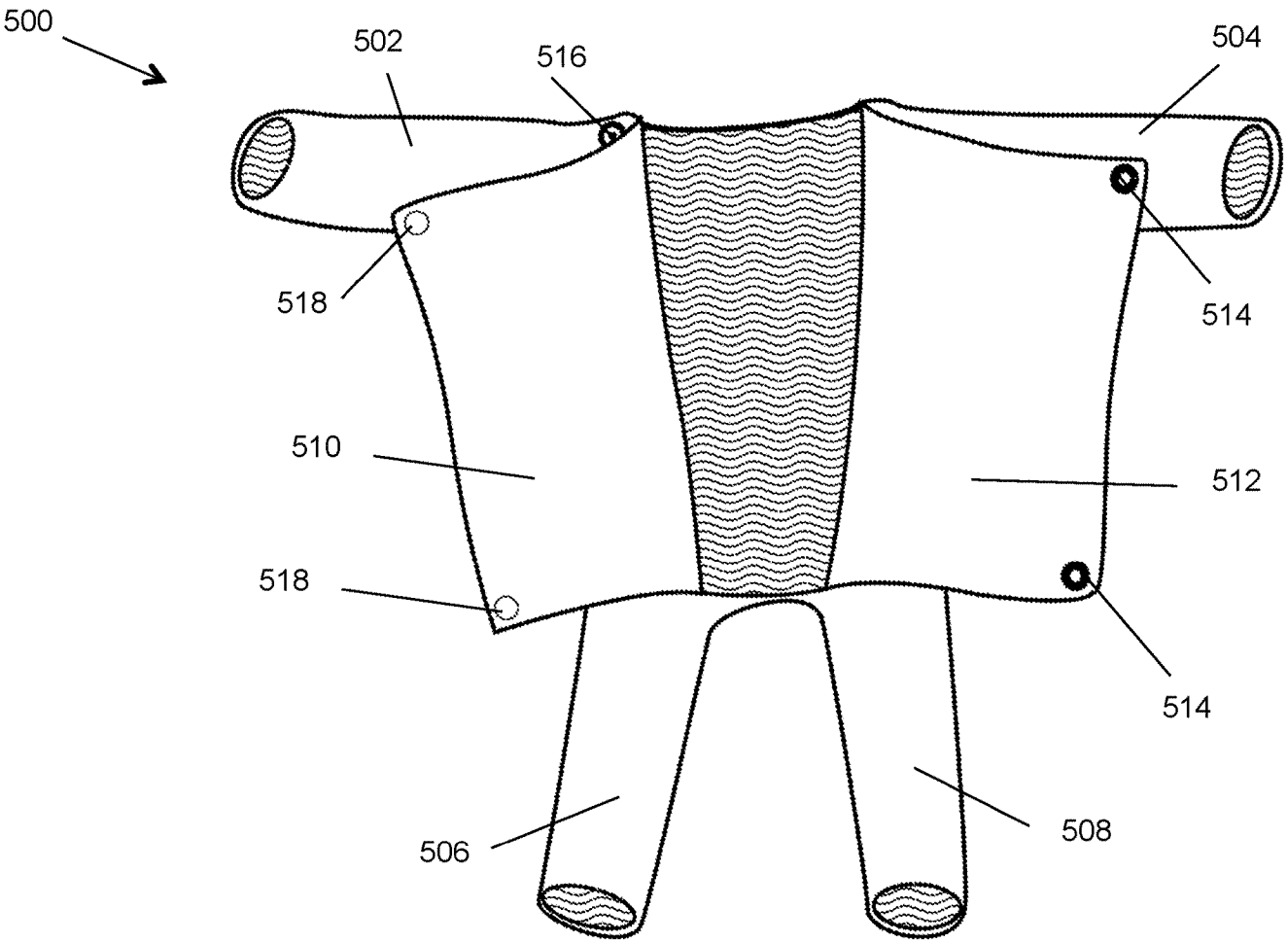
FIG. 5A is a front view of a fifth preferred embodiment of the invented garment with two panels open.
Figure 5B:
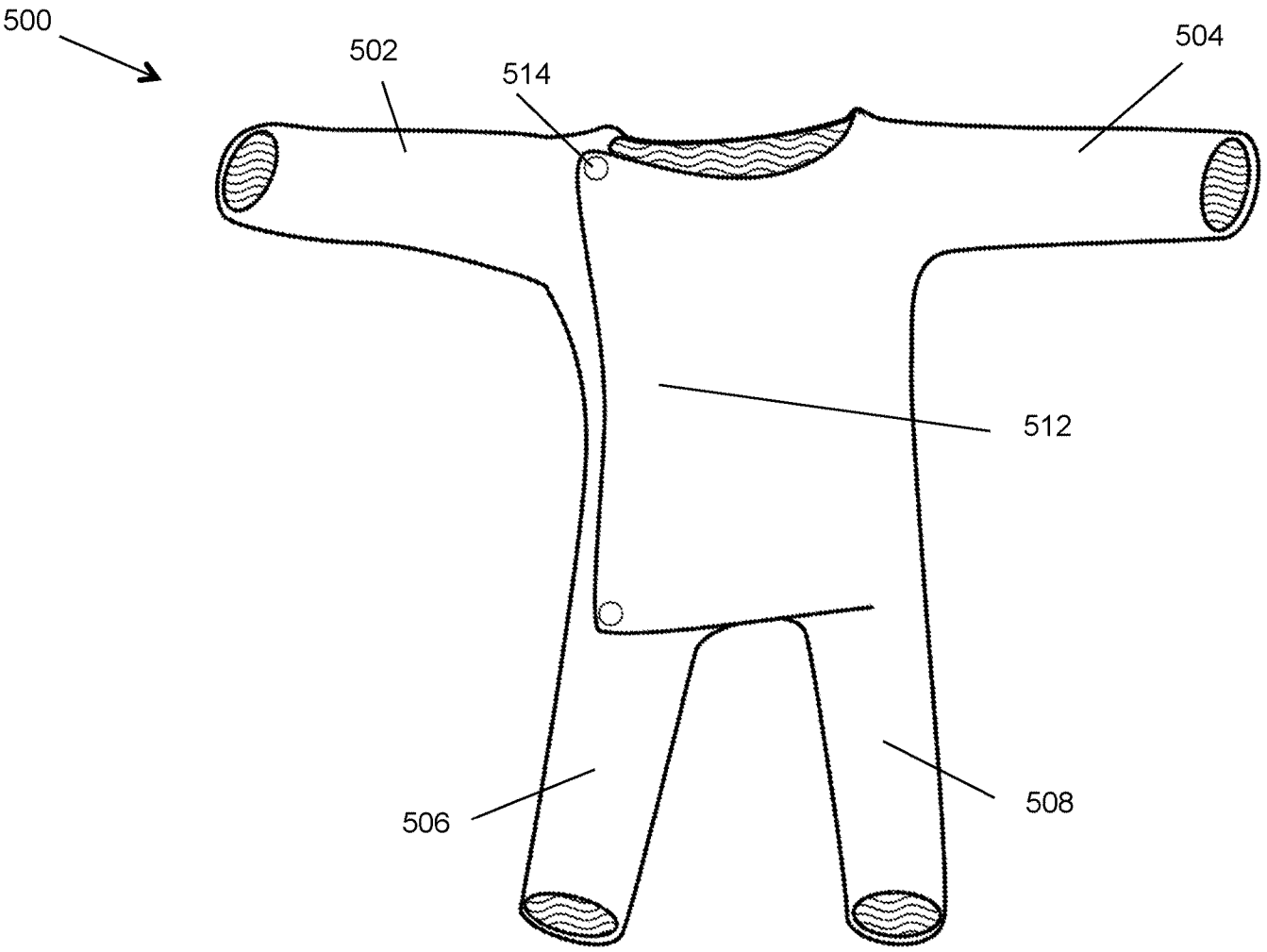
FIG. 5B is a front view of the fifth preferred embodiment of the invented garment of FIG. 5A with both panels closed.

Referring now generally to the Figures and particularly to FIGS. 5A and 5B and, FIGS. 5A and 5B present a fifth alternate preferred embodiment of the present invention 500, or fifth design 500, in a first state of FIG. 5A that exposes the portion of a wearer's skin in FIG. 5A and in an alternative second state of the fifth design 500 of FIG. 5B that would cover, and protect said portion of wearer's skin with a fifth set of alternate panels 510 & 512. The fifth design 500 includes sleeves 502 & 504 and leggings 506 & 508, a plurality of fastener components and elements 514 & 518.

Figure 6A:
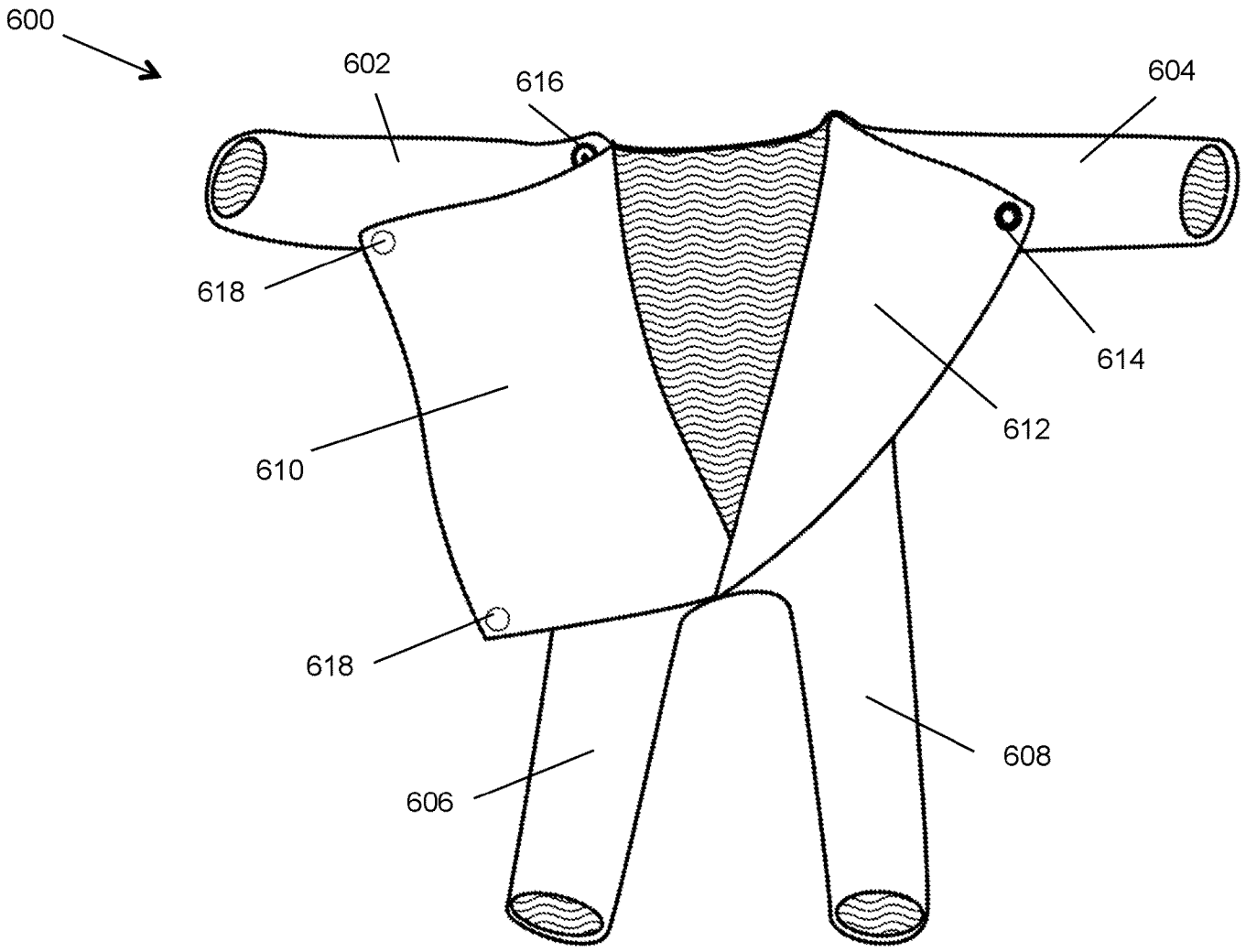
FIG. 6A is a front view of a sixth preferred embodiment of the invented garment with two panels open.
Figure 6B:
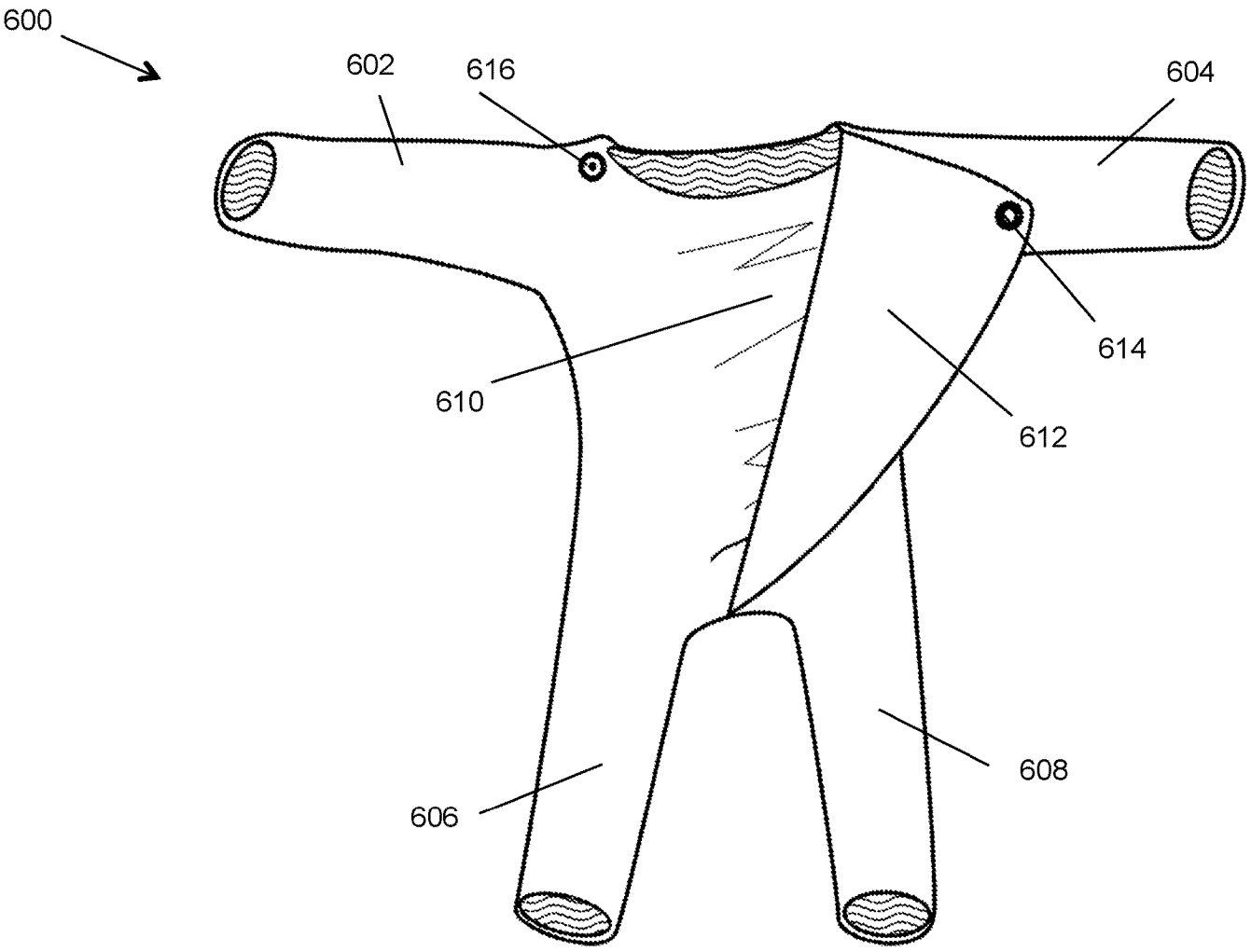
FIG. 6B is a front view of the sixth preferred embodiment of the invented garment of FIG. 6A with one panel open.
Figure 6C:
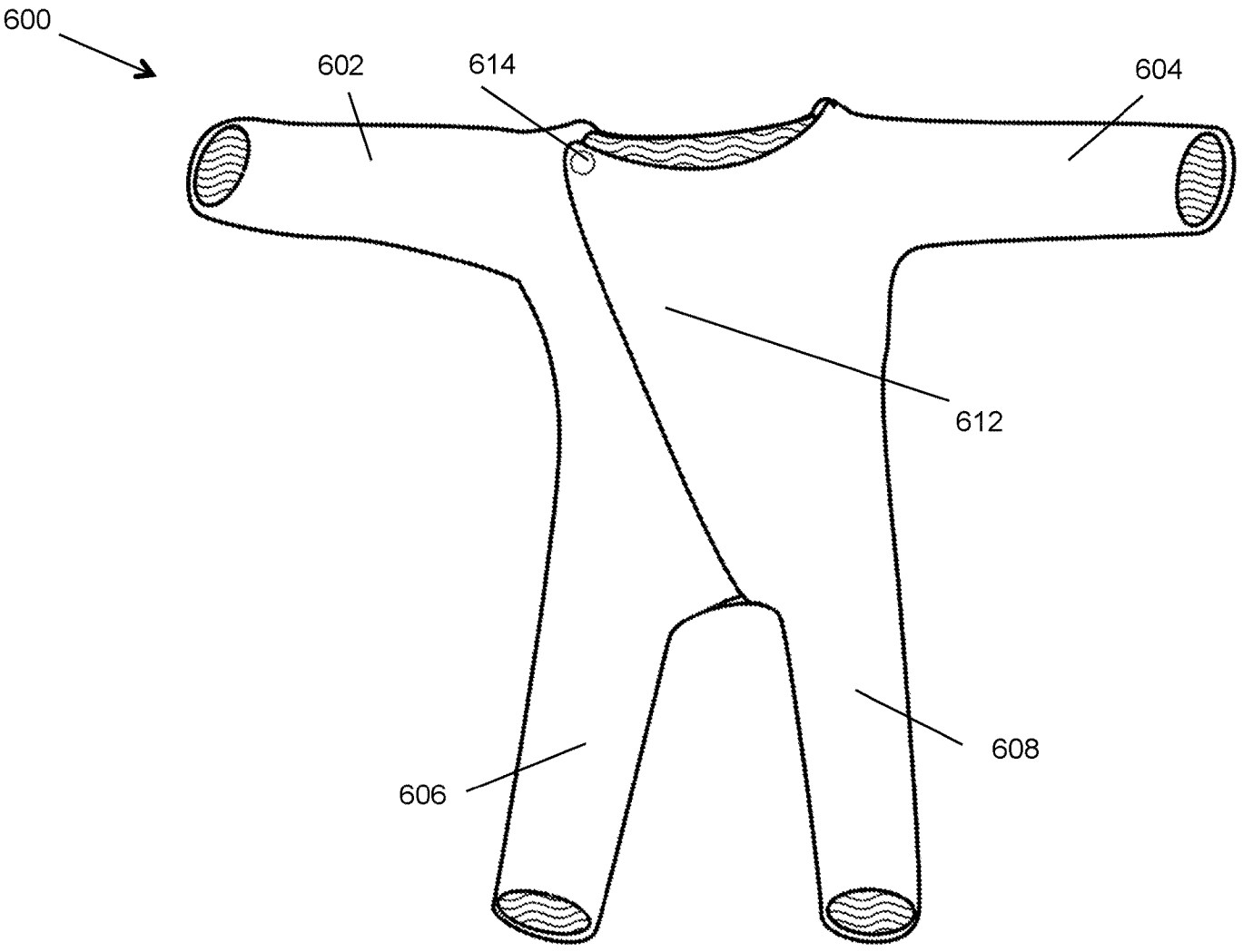
FIG. 6C is a front view of the sixth preferred embodiment of the invented garment of FIG. 6A with both panels closed.

Referring now generally to the Figures and particularly to FIGS. 6A, 6B and 6C, FIGS. 6A, 6B and 6C present a sixth alternate preferred embodiment of the present invention 600, or sixth design 600, in a first state of FIG. 6A that exposes the portion of a wearer's skin in FIG. 6A and in an alternative second state of the sixth design 600 of FIG. 6C that would cover, and protect said portion of wearer's skin with a sixth set of alternate panels 610 & 612. The sixth design 600 includes sleeves 602 & 604 and leggings 606 & 608, a plurality of fastener components and elements 614 & 618.

Figure 7A:
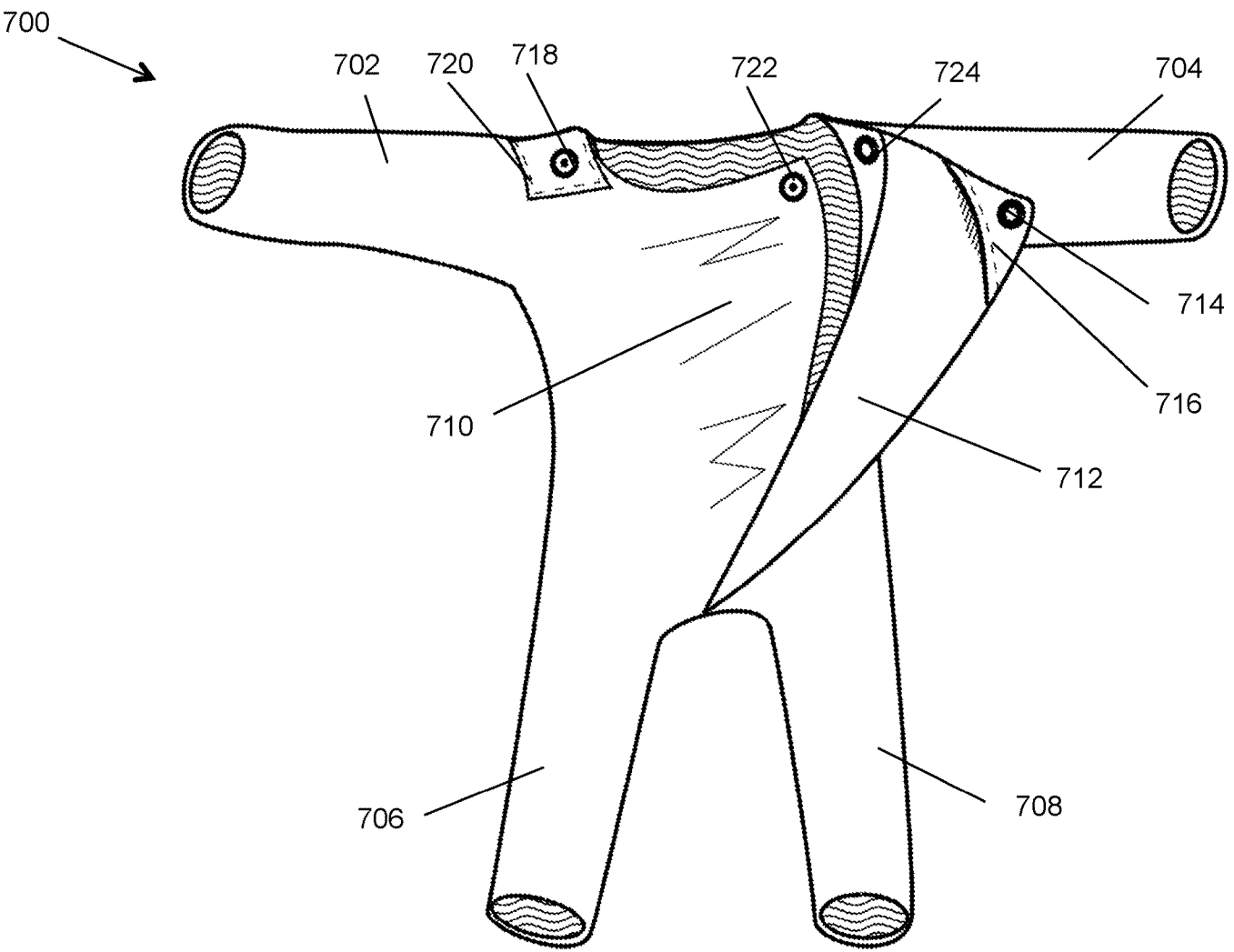
FIG. 7A is a front view of a seventh preferred embodiment of the invented garment with one panel open.
Figure 7B:
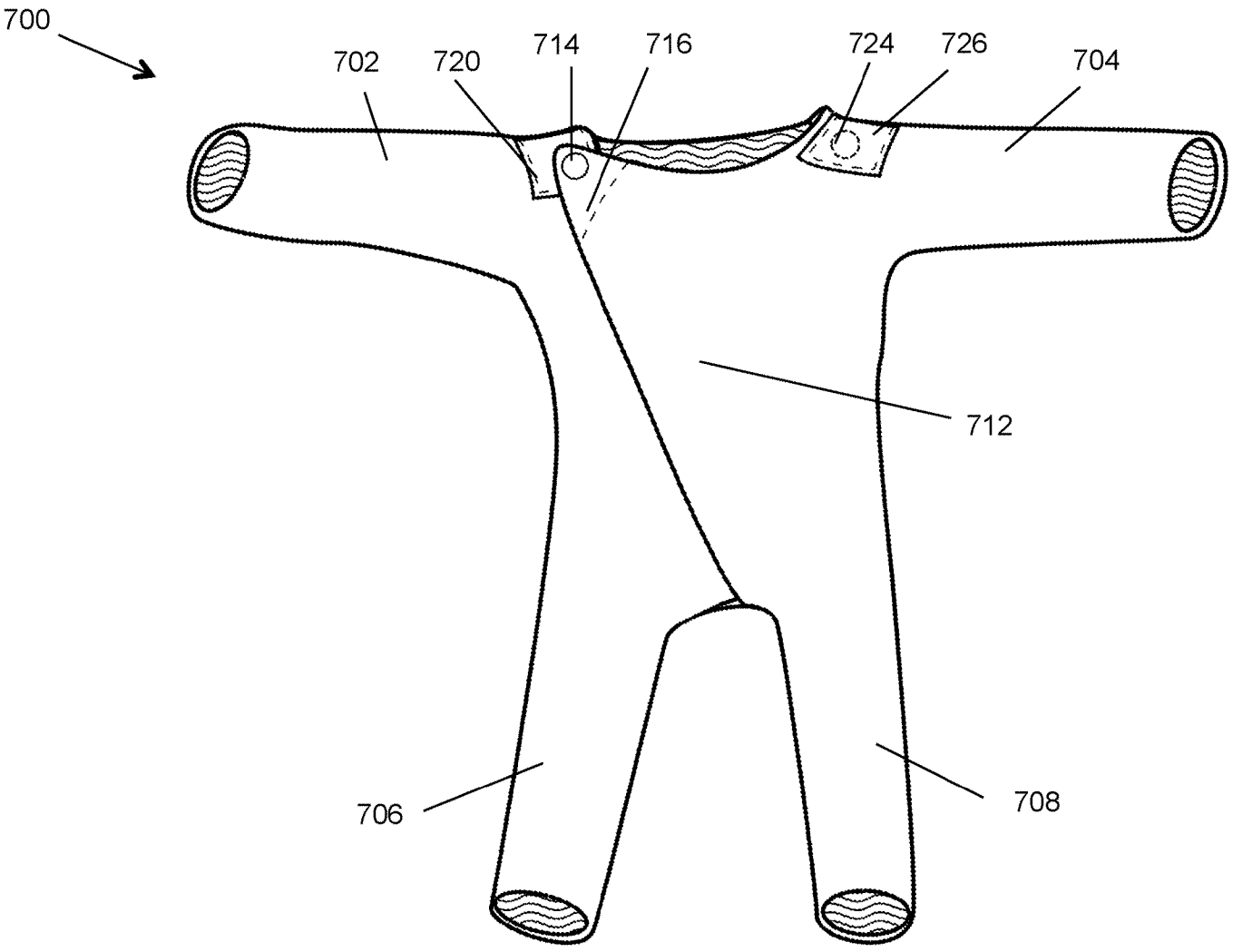
FIG. 7B is a front view of the seventh preferred embodiment of the invented garment of FIG. 7A with both panels closed.

Referring now generally to the Figures and particularly to FIGS. 7A and 7B, FIGS. 7A and 7B present a seventh alternate preferred embodiment of the present invention 700, or seventh design 700, in a first state of FIG. 7A that exposes the portion of the wearer's skin in FIG. 7A and in an alternative second state of the seventh design 700 of FIG. 7B that would cover, and protect said portion of wearer's skin with a seventh set of alternate panels 710 & 712. The seventh design 700 includes sleeves 702 & 704 and leggings 706 & 708, a plurality of fastener components and elements 714 & 724 and fastener reinforcement material strips 720 & 726.

Figure 8:
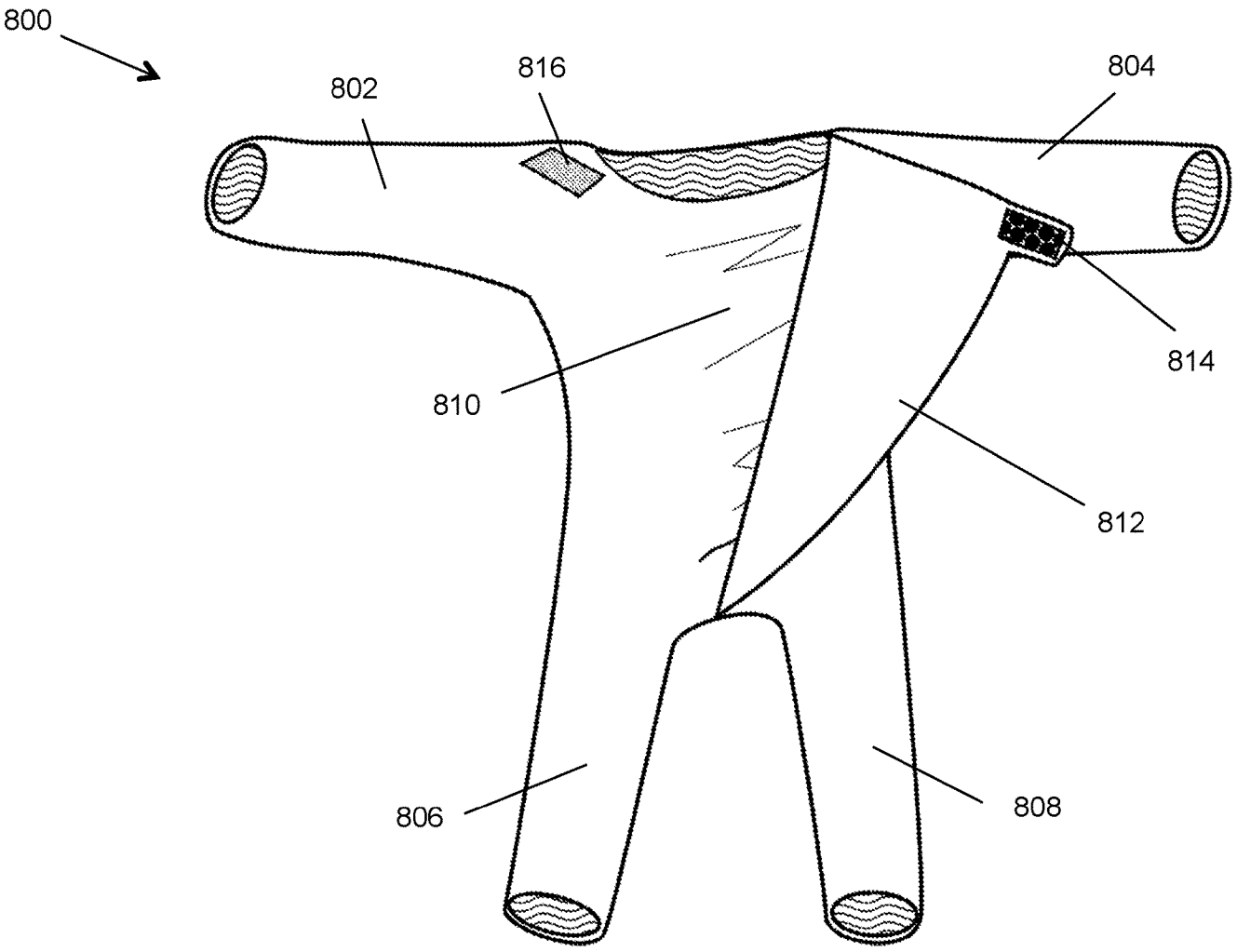
FIG. 8 is a front view of an eighth preferred embodiment of the invented garment with one panel open and comprising a plurality of hook and loop fastener component and elements.

Referring now generally to the Figures and particularly to FIG. 8, FIG. 8 presents a eighth alternate preferred embodiment of the present invention 800, or eighth design 800, that protects said portion of wearer's skin with a eighth set of alternate panels 810 & 812. The eighth design 800 includes sleeves 802 & 804 and leggings 806 & 808, a plurality of hook and loop fastener component and elements 814 & 816.

Figure 9:
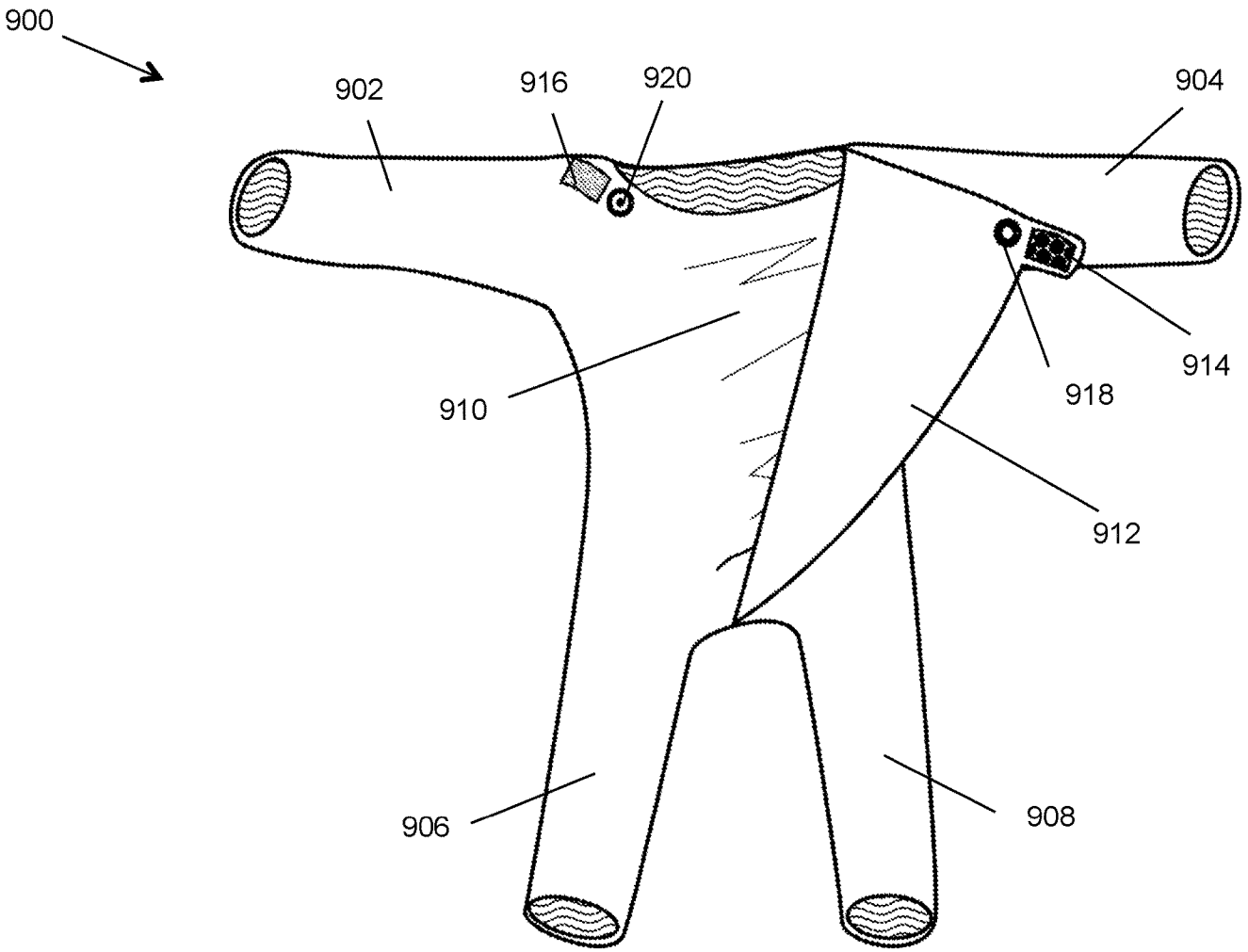
FIG. 9 is a front view of a ninth preferred embodiment of the invented garment with one panel open and comprising a plurality of hook and loop fastener component and elements and a set of snap fastening components.

Referring now generally to the Figures and particularly to FIG. 9, FIG. 9 presents an ninth alternate preferred embodiment of the present invention 900, or ninth design 900, that protects said portion of wearer's skin with an ninth set of alternate panels 910 & 912. The ninth design 900 includes sleeves 902 & 904 and leggings 906 & 908, a plurality of hook and loop fastener component and elements 914 & 916, and a set of snap fastening components 919 & 820.

Figure 10:
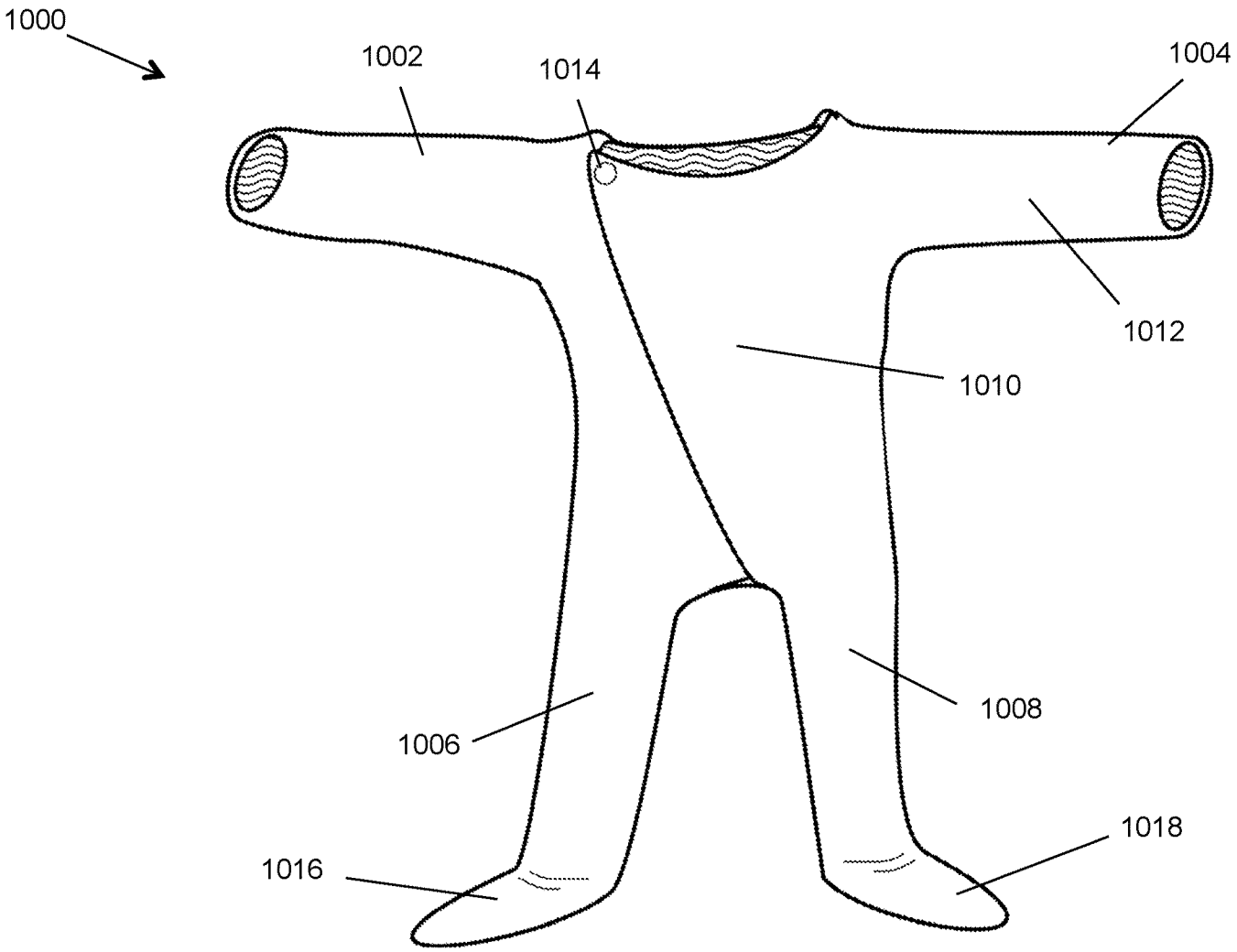
FIG. 10 is a front view of a tenth preferred embodiment of the invented garment with two panels closed and comprising a pair of booties.

Referring now generally to the Figures and particularly to FIG. 10, FIG. 10 presents a tenth alternate preferred embodiment of the present invention 1000, or tenth design 1000, that protects said portion of wearer's skin with the tenth set of alternate panels 1010 & 1012. A fastener assembly 1014 removably couples the panel 1010 & 1012 together. The tenth design 1000 includes sleeves 1002 & 1004, a first pant leg 1006 that includes a first bootie 1016, and a second pant leg 1008 that includes a second bootie 1018.

Figure 11:
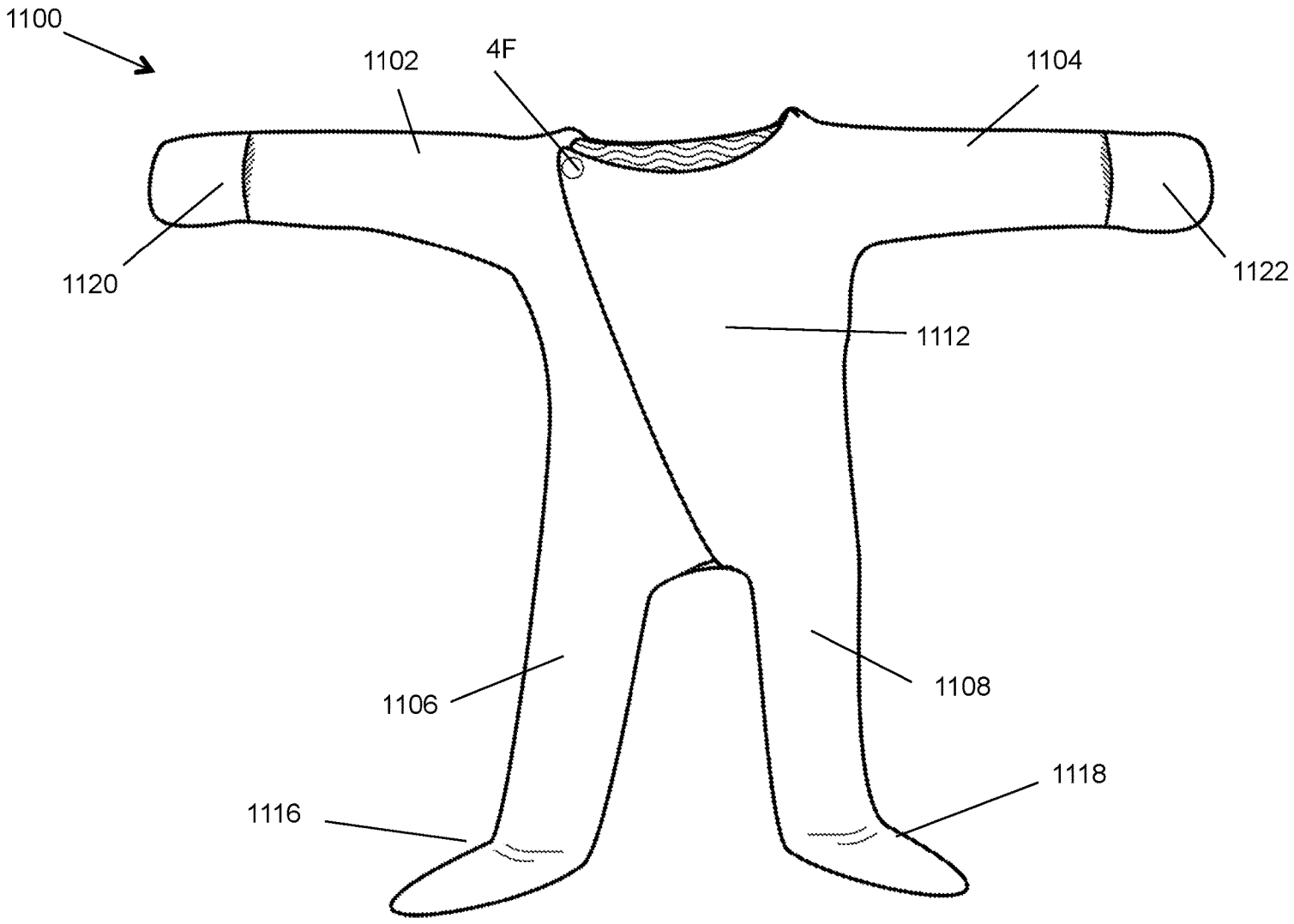
FIG. 11 is a front view of an eleventh preferred embodiment of the invented garment with two panels closed and comprising a pair of mittens.

Referring now generally to the Figures and particularly to FIG. 11, FIG. 11 presents a eleventh alternate preferred embodiment of the present invention 1100, or eleventh design 1100, that protects said portion of wearer's skin with a eleventh set of alternate panels 1110 & 1112. A fastener assembly 1114 removably couples the panels 1110 & 1112 together. The eleventh design 1100 includes sleeves 1102 & 1104, a first pant leg 1106 that includes a first bootie 1116, and a second pant leg 1108 that includes a second bootie 1118. Each sleeve 1102 & 1104 is respectively coupled with a single mitten element 1120 & 1122.

Figure 12:
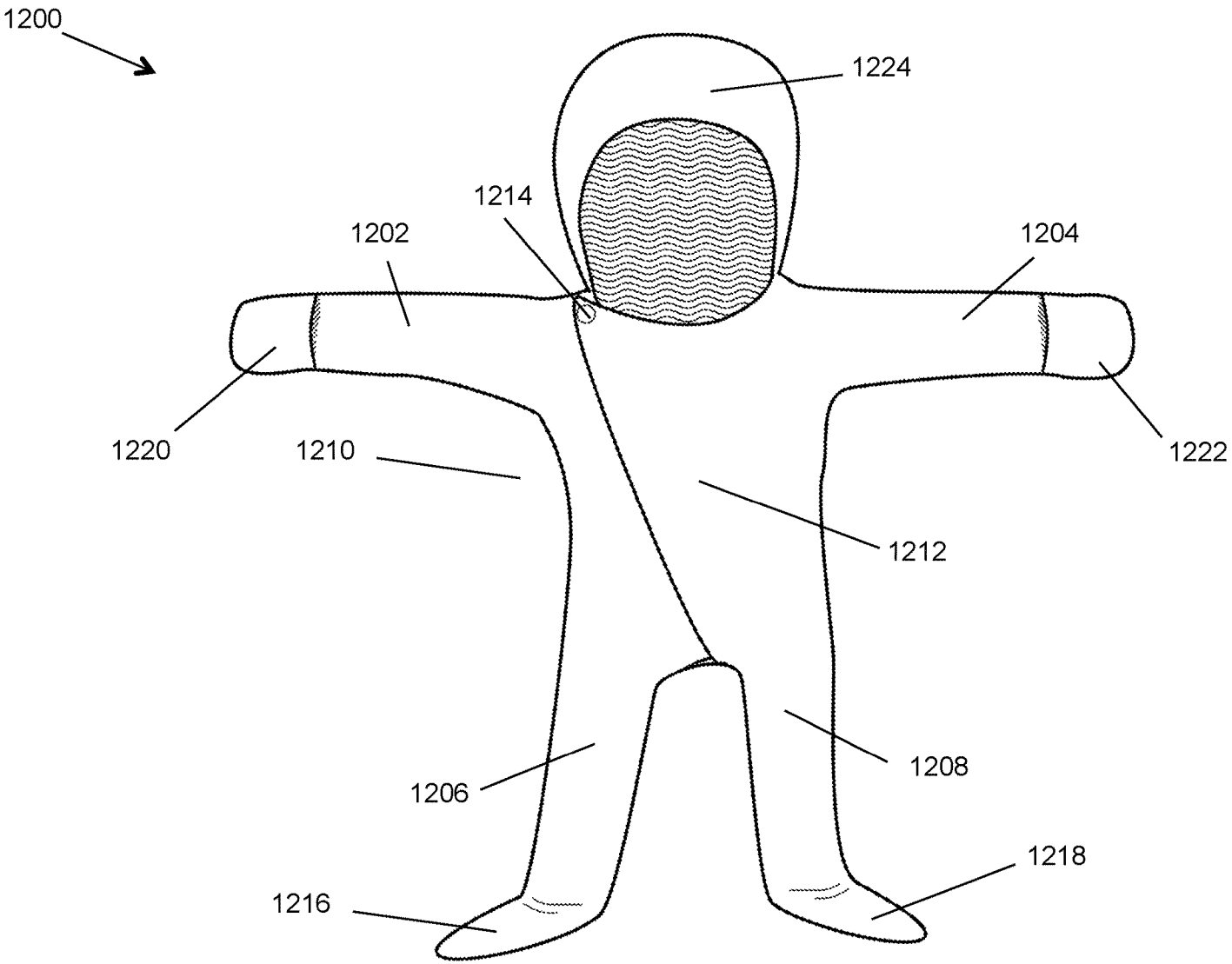
FIG. 12 is a front view of a twelfth preferred embodiment of the invented garment with two panels closed and comprising a hooding element, a pair of mittens and a pair of booties.

Referring now generally to the Figures and particularly to FIG. 12, FIG. 12 presents a twelfth alternate preferred embodiment of the present invention 1200, or twelfth design 1200, that protects said portion of wearer's skin with an twelfth set of alternate panels 1210 & 1212. A fastener assembly 1214 removably couples the panel 1210 &1212 together. The twelfth design 1200 includes sleeves 1202 &

1204, a first pant leg 1206 that includes a first bootie 1216, and a second pant leg 1208 that includes a second bootie 1218. Each sleeve 1202 & 1204 is respectively coupled with a single mitten element 1220 & 1222. The twelfth design 1200 further includes a hooding element 1224.

Figure 13:
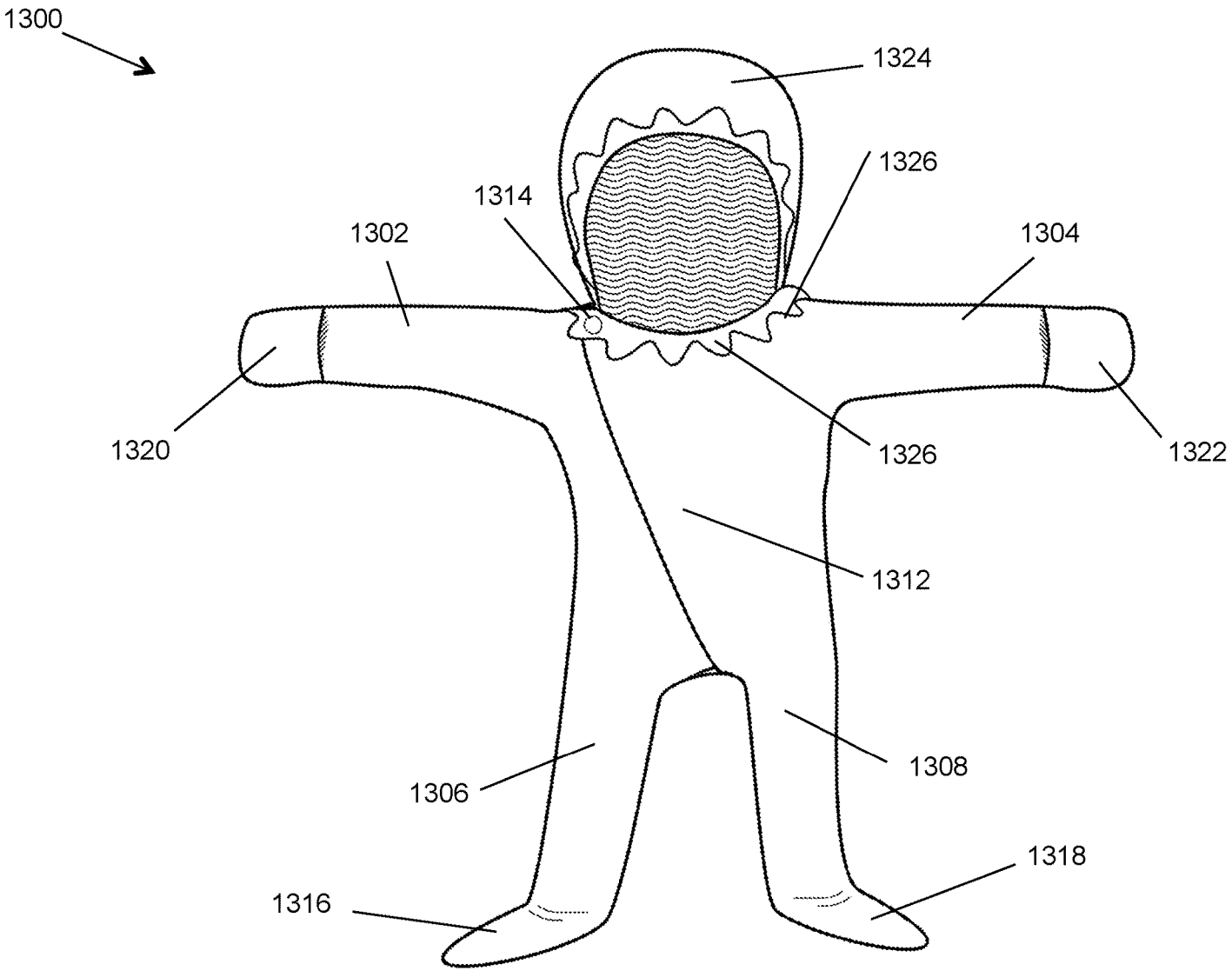
FIG. 13 is a front view of an thirteenth preferred embodiment of the invented garment with two panels closed and comprising a hooding element, a collar element, a pair of mittens and a pair of booties.

Referring now generally to the Figures and particularly to FIG. 13, FIG. 13 presents a thirteenth alternate preferred embodiment of the present invention 1300, or thirteenth design 1300, that protects said portion of wearer's skin with an twelfth set of alternate panels 1310 & 1313. A fastener assembly 1314 removably couples the panel 1310 &1313 together. The thirteenth design 1300 includes sleeves 1302 & 1304, a first pant leg 1306 that includes a first bootie 1316, and a second pant leg 1308 that includes a second bootie 1318. Each sleeve 1302 & 1304 is respectively coupled with a single mitten element 1320 & 1322. The twelfth design 1100 further includes a hooding element 1134 coupled with a collar element 1326.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible configurations or aspects of the Present Invention. The examples given should only be interpreted as illustrations of some of the preferred configurations or aspects of the Present Invention, and the full scope of the Present Invention should be determined by the appended claims and their legal equivalents. Those skilled in the art will appreciate that various adaptations and modifications of the just-described preferred embodiments can be configured without departing from the scope and spirit of the Present Invention. Therefore, it is to be understood that the Present Invention may be practiced other than as specifically described herein. The scope of the present invention as disclosed and claimed should, therefore, be determined with reference to the knowledge of one skilled in the art and in light of the disclosures presented above.

I claim:

1. A clothing apparatus to be worn by an infant comprising:

a garment sized and configured for being worn by the infant, the garment providing a frontal opening, the frontal opening defined by a first side and a second side, a first leg aperture and a second leg aperture, wherein an inferior portion of the garment is disposed between the first lei aperture and the second leg aperture;

a first panel, the first panel integrally coupled with the garment first side, and the first panel having a first detachable attachment feature for detachable attachment to the garment second side, wherein the first panel adjustably extends from the first detachable attachment feature to the garment second side and the first panel imposes a tension on the garment between the first detachable attachment feature and the inferior portion of the garment; and a second panel, integrally coupled with the garment second side, and the second panel having a second detachable attachment feature for detachable attachment to the garment first side, wherein the second panel is integrally coupled with the first overlapping panel at the inferior portion and additionally adjustably extends from the second detachable attachment feature to the garment first side and the second panel imposes a tension on the garment between the second detachable attachment feature and the inferior portion of the garment, whereby, with the garment worn by the infant, both panels are alternately positionable for allowing contact with the infant's anterior torso skin without unclothing the sides or inferior end of the infant's torso, or closed to cover the infant's anterior torso skin, wherein when both pulling the first detachable attachment feature away from the second panel and pulling the second detachable attachment feature away from the first panel, the folded edges of the first panel and the second panel define an opening forming a skin exposure of the infant's anterior torso for skin to skin contact with a caregiver.

2. The clothing apparatus of claim 1, wherein the first detachable attachment feature is comprised within a first snap assembly.

3. The clothing apparatus of claim 1, wherein the second detachable attachment feature is comprised within a second snap assembly.

4. The clothing apparatus of claim 3, wherein the first detachable attachment feature is comprised within an additional snap assembly.

5. The clothing apparatus of claim 1, further comprising a legging coupled with the garment.

6. The clothing apparatus of claim 5, further comprising a second legging coupled with the garment.

7. The clothing apparatus of claim 6, the garment further comprising: two sleeves.

8. The clothing apparatus of claim 5, wherein at least one legging comprises a booting element sized and shaped for snugly enclosing one foot of the infant.

9. The clothing apparatus of claim 5, wherein the legging is sized and shaped for fitting snugly about a leg of the infant.

10. The clothing apparatus of claim 1, further comprising a sleeve coupled with the garment.

11. The clothing apparatus of claim 10, further comprising a second sleeve coupled with the garment.

12. The clothing apparatus of claim 10, wherein the sleeve is sized and shaped for fitting snugly about an arm of the infant.

13. The clothing apparatus of claim 1, further comprising a first reinforcing tab positioned on the garment for engagement with the first detachable attachment feature.

14. The clothing apparatus of claim 13, further comprising a second reinforcing tab positioned on the garment for engagement with the second detachable attachment feature.

15. The clothing apparatus of claim 1, further comprising an additional detachable attachment feature coupled with the first panel.

16. The clothing apparatus of claim 15, further comprising a second additional detachable attachment feature coupled with the second panel.

17. The clothing apparatus of claim 15, wherein the additional detachable attachment feature comprises an attachment feature selected from the attachment group consisting of: (a) a hook and loop fastener set, and (b.) a snap assembly comprising a first snap half and a second snap half that detachably fasten together.

18. The clothing apparatus of claim 1, wherein the first detachable attachment feature comprises an attachment feature selected from the attachment group consisting of a hook and loop fastener set, and a snap assembly comprising a first snap half and a second snap half that detachably fasten together.

19. The clothing apparatus of claim 1, wherein the second detachable attachment feature comprises an attachment feature selected from the attachment group consisting of: (a) a hook and loop fastener set, and (b.) a snap assembly comprising a first snap half and a second snap half that detachably fasten together.

20. The clothing apparatus of claim 1, wherein the garment is sized and shaped for fitting snugly about the infant.

21. The clothing apparatus of claim 1, wherein the garment comprises a fabric selected from the garment group consisting of cotton, wool, organic fabric, and/or synthetic fabric in singularity or in combination.

22. The clothing apparatus of claim 1, wherein the first detachable attachment feature and the second detachable attachment feature are compatible for fastening detachably together to form a detachable attachment assembly positioned against a posterior side of the garment, such that the first panel and second panel may be secured detachably together behind the infant's back when the garment is in an open position.

23. A clothing apparatus to be worn by an infant comprising:

a garment sized and configured for being worn by the infant, the garment providing a frontal opening, the frontal opening defined by a first side and a second side, a first leg aperture and a second leg aperture, wherein an inferior portion of the garment is disposed between the first leg aperture and the second leg aperture;

a first panel, the first panel integrally coupled with the garment first side, and the first panel having a first detachable attachment feature for detachable attachment to a second detachable attachment feature positioned on the garment second side and compatible for detachable attachment to the first detachable attachment feature, forming a first detachable attachment assembly comprising the first detachable attachment feature and the second detachable attachment feature, wherein the first panel adjustably extends from the first detachable attachment assembly in a closed position to the garment first side and the first panel imposes a tension on the garment between the first detachable attachment assembly in a closed position and the inferior portion of the garment; and a second panel, the second panel integrally coupled with the garment second side, and the second panel having a third detachable attachment feature for detachable attachment to a fourth detachable attachment feature positioned on the garment first side and compatible for detachable attachment to the third detachable attachment feature, forming a second detachable attachment assembly comprising the third detachable attachment feature and the fourth detachable attachment feature, wherein the second panel adjustably extends from the second detachable attachment assembly in a closed position to the garment second side and the second panel imposes a tension on the garment between the second detachable attachment assembly in a closed position and the inferior portion of the garment, whereby, with the garment worn by the infant, both panels are alternately positionable for allowing contact with the infant's anterior torso skin without unclothing the sides or inferior end of the infant's torso, or closed to cover the infant's anterior torso skin, wherein when both pulling the first detachable attachment feature away from the second detachable attachment feature and pulling the third detachable attachment feature away from the fourth detachable attachment feature, the folded edges of the first panel and the second panel define an opening forming a skin exposure of the infant's anterior torso for skin to skin contact with a caregiver; and whereby the first panel and second panel may be detachably fastened together behind the posterior side of the infant, by means of a third detachable attachment assembly, when the garment is in an open position.

24. The clothing apparatus of claim 23, wherein the first detachable attachment assembly, the second detachable attachment assembly, and the third detachable attachment assembly each comprise a compatibly matched pair of fasteners.

25. The clothing apparatus of claim 24, wherein one or more matched pairs of compatible fasteners comprise snap fastener assemblies.

26. The clothing apparatus of claim 24, further comprising a fifth detachable attachment feature located adjacent to the first detachable attachment feature, and a sixth detachable attachment feature located adjacent to the third detachable attachment feature, the fifth detachable attachment feature and sixth detachable attachment features comprising the third detachable attachment assembly.

27. The clothing apparatus of claim 24, wherein one or more matched pairs of compatible fasteners comprise hook-and-loop fastener assemblies.

28. The clothing apparatus of claim 24, wherein the third detachable attachment assembly comprises the first detachable attachment feature and the third detachable attachment feature.

29. The clothing apparatus of claim 28, wherein the first detachable attachment feature comprises a first snap socket side, the second detachable attachment feature comprises a first snap stud side, the third detachable attachment feature comprises a second snap stud side identical to the first snap stud side, and the fourth detachable attachment feature comprises a second snap socket side identical to the first snap socket side.

* * * * *